US006574448B2

(12) United States Patent
Mochimaru et al.

(10) Patent No.: US 6,574,448 B2
(45) Date of Patent: Jun. 3, 2003

(54) IMAGE FORMING APPARATUS AND METHOD FOR IMPROVING IMAGE QUALITY OF DOUBLE SIDED PRINTS

(75) Inventors: Hideaki Mochimaru, Yokohama (JP); Yasukuni Omata, Chigasaki (JP); Norimasa Sohmiya, Sohka (JP); Mitsuru Seto, Kanagawa-ken (JP); Toshiaki Higaya, Kawasaki (JP); Masanori Matsuda, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 45 days.

(21) Appl. No.: 09/877,184

(22) Filed: Jun. 11, 2001

(65) Prior Publication Data

US 2002/0015602 A1 Feb. 7, 2002

(30) Foreign Application Priority Data

| | | |
|---|---|---|
| Jun. 9, 2000 | (JP) | 2000-173701 |
| Jun. 9, 2000 | (JP) | 2000-173702 |
| Aug. 10, 2000 | (JP) | 2000-242917 |
| May 22, 2001 | (JP) | 2001-152437 |
| May 14, 2001 | (JP) | 2001-143379 |
| May 17, 2001 | (JP) | 2001-147928 |

(51) Int. Cl.[7] ..... G03G 15/16
(52) U.S. Cl. ..... 399/309; 399/308; 399/328
(58) Field of Search ..... 399/297, 298, 399/299, 302, 303, 306, 308, 309, 364, 397, 400, 401, 328; 219/216

(56) References Cited

U.S. PATENT DOCUMENTS

| | | | | |
|---|---|---|---|---|
| 4,605,299 A | | 8/1986 | Mochimaru | |
| 4,757,344 A | | 7/1988 | Idenawa et al. | |
| 4,875,063 A | | 10/1989 | Idenawa et al. | |
| 5,615,872 A | | 4/1997 | Mochimaru | |
| 6,047,156 A | * | 4/2000 | De Bock et al. | 399/298 |
| 6,151,057 A | | 11/2000 | Yamazaki et al. | |

OTHER PUBLICATIONS

U.S. patent application Ser. No. 09/877,184, filed Jun. 11, 2001, pending.

U.S. patent application Ser. No. 09/915,398, filed Jul. 27, 2001, pending.

U.S. patent application Ser. No. 09/962,681, Sep. 26, 2001, pending.

U.S. patent application Ser. No. 09/960,295, filed Sep. 24, 2001, pending.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a first image bearing member, a second image bearing member, and a fixing device. A first visual image formed on the first image bearing member is transferred onto the second image bearing member to be transferred from the second image bearing member onto a first side of a recording medium, and a second visual image formed on the first bearing member is transferred from the first image bearing member onto a second side of the recording medium, so that the visual images are obtained on the first and second sides of the recording medium respectively. The visual images on the first and second sides of the recording medium are fixed by the fixing device in a state that the second image bearing member and the recording medium are overlapped with each other.

145 Claims, 18 Drawing Sheets

IMAGE FORMING APPARATUS AND METHOD FOR IMPROVING IMAGE QUALITY OF DOUBLE SIDED PRINTS

BACKGROUND OF THE INVENTION

1. Field of the Invention

The present invention relates to an apparatus and a method of forming images on both sides of a recording medium.

2. Discussion of the Background

Image forming apparatuses, such as copying machines, printers and facsimile machines, are known to include devices that are configured to form images on both sides of a recording medium (hereinafter sometime referred to as a sheet). Such image forming apparatuses capable of recording images on both sides of a sheet generally transfer an image of one side of an original, which has been formed and visualized on an image bearing member, onto one side of a sheet, and then fix the image onto the sheet by a fixing device. The sheet is then reversed by a reversing path etc., and is conveyed again so that an image of the other side of the original, which has been also visualized on the image bearing member, is transferred and fixed onto the other side of the sheet.

In the above image forming apparatuses, because a sheet conveying direction has to be reversed, and a sheet tends to be curled when an image is fixed onto one side of the sheet, reliability of sheet conveyance is hard to obtain. Further, a curled sheet causes inferior transfer of a toner image, resulting in deteriorating the image quality. Japanese Patent Laid-open Publications No. 1-209470, No. 3-253881 and 10-142869 respectively disclose an image forming apparatus in which toner images, which have been transferred onto both sides of a sheet from a first image bearing member and a second image bearing member, are fixed at one time.

Japanese Patent Laid-opened Publication No. 1-209470 discloses an image forming apparatus that transfers a first image formed on a photoconductor onto a transfer belt by a first transfer device, and then transfers a second image formed on the photoconductor onto one side of a sheet by a second transfer. The image forming apparatus then transfers the first image on the transfer belt onto the other side of the sheet by a second transfer device, thus transferring the images on both sides of the sheet. The sheet is then conveyed to a fixing device, where the images are fixed onto both sides of the sheet.

Japanese Patent Laid-open Publication No. 3-253881 discloses another image forming apparatus, which is similar to the one disclosed in the above-described JP Publication No. 1-209470. In the image forming apparatus, polarity of a second image formed on a photoconductor, which has been visualized as a toner image, is reversed on the photoconductor before a transfer process so that transfer of toner images onto both sides of a sheet is enabled without requiring a second transfer device. The sheet is then conveyed to a fixing device where the toner images on both sides of the sheet are fixed thereupon respectively.

Japanese Patent Laid-open Publication No. 10-142869 discloses another image forming apparatus that includes two transfer devices. After transferring color images onto both sides of a sheet, the sheet is conveyed to a fixing device, and the images are fixed onto both sides of the sheet at one time at the fixing device. The image forming apparatus includes a spur having a plurality of protrusions on its circumferential surface so as to guide conveyance of a sheet carrying unfixed toner images on both sides thereof.

Each of the above-described image forming apparatuses separates a sheet, carrying unfixed toner images on both sides thereof, from a transfer belt to convey the sheet to a fixing device. Therefore, the toner images carried on both sides of the sheet tend to be disturbed when the sheet is being conveyed separated from the transfer belt or when the sheet abuts on the fixing device.

Further, each of the image forming apparatuses disclosed in JP Publications No. 1-209470 and No. 3-253881 does not include a guide device to guide a sheet so as to be conveyed to a fixing device. Therefore, the sheet is not smoothly conveyed to the fixing device and an image carried on the sheet is disturbed or the sheet is jammed thereby reducing reliability for the image forming apparatus. Furthermore, it is relatively difficult to make the speeds of a transfer belt and a fixing device substantially the same. Therefore, when a sheet being conveyed by the transfer belt reaches a fixing device which has a conveying force generally larger than that of the transfer belt, the sheet starts to be conveyed by the fixing device at the speed of the fixing device. Thereby, images carried on the sheet are easily disturbed, causing image blurring as a result.

In the image forming apparatus of JP Publication No. 10-142869, an unfixed image tends to touch the spur, thus easily causing deterioration of an image quality. Further, as described above, because it is relatively difficult to make the speeds of a transfer belt and a fixing device substantially the same, when a sheet being conveyed by the transfer belt reaches a fixing device which has a conveying force generally larger than that of the transfer belt, the sheet is conveyed by the fixing device at the speed of the fixing device thereby causing images carried on the sheet to be easily disturbed and, as a result, image blurring.

FIGS. 1(*a*)–1(*d*) are schematic drawings for explaining background processes of transferring toner images onto both sides of a sheet. In FIG. 1(*a*) illustrating a state of a developing and a first transferring processes, a negatively charged toner image of a first side of an original formed on a photoconductor drum 1 serving as a first image bearing member is transferred onto an intermediate transfer belt 10 serving as a second image bearing member 10 by a first transfer device 21 applying a positive voltage. In FIG. 1(*b*) illustrating a state of a second developing process, another negatively charged toner image of the second side of the original is formed on the photoconductor drum 1, and at the same time the first side toner image carried on the intermediate transfer belt 10 reaches a position where the first side toner image has been transferred onto the intermediate transfer belt 10 from the photoconductor drum 10 after making one round. Further, a sheet is conveyed so as to be correctly positioned relative to the first and second side toner images.

In FIG. 1(*c*) illustrating a state of a second transferring process, the negatively charged second side toner image on the photoconductor drum 1 is transferred onto the second side of the sheet by the first transfer device 21 applying a positive voltage. At this time, the first side toner image on the intermediate transfer belt 10 is overlapped with the sheet. In FIG. 1(*d*) illustrating a third transferring process, a second transfer device 22 is turned on to apply a positive voltage, so that the negatively charged first side toner image on the intermediate transfer belt 10 is transferred onto the first side of the sheet. The sheet is then conveyed to a fixing device (not shown) and a cleaning operation is performed for the intermediate transfer belt 10.

Thus, the transfer process is performed three times. In particular, in the third transferring process, the first side toner image on the intermediate transfer belt 10 is transferred onto the sheet by applying the voltage with the second transfer device 22 from the side of the second side of the sheet onto which the second side toner image has been transferred from the photoconductor drum 1. Therefore, because of an effect of charging, the second side toner image transferred on the second side of the sheet tends to be disturbed. Further, increase of the charge of the sheet may cause electrostatic offsetting of the toner image in the fixing operation.

Japanese Patent Laid-open Publication No. 3-253881 discloses an image forming apparatus in which transfer of images onto both sides of a sheet is realized by a transfer device arranged at the side of the first side of the sheet. The first image formed on a photoconductor is transferred onto a transfer belt by a first transfer belt, and the polarity of a second image formed on the photoconductor is reversed on the photoconductor before a transfer process is performed, so that the polarities of the first and second images differ from each other. Thereby, the first and second images are transferred onto both sides of a sheets at the same time by a single transfer device.

Japanese Patent Laid-open publication No. 2000-105513 discloses use of two developing devices to differentiate the polarities of first and second images. Further, the polarity of a transfer voltage is made changeable, so that the first and second image can be transferred onto both sides of a sheet at the same time.

FIGS. 2(*a*)–2(*d*) are schematic drawings for explaining processes of transferring images onto both sides of a sheet in the image forming apparatus of JP publication No. 3-253881. In FIG. 2(*a*) illustrating a state of developing and a first transferring processes, a negatively charged toner image formed on the photoconductor drum 1 is transferred onto the intermediate transfer belt 10 by the transfer device 21 applying a positive charge. In FIG. 2(*b*) illustrating a state of a second developing process, the polarity of another negatively charged toner image formed on the photoconductor drum 1 is reversed to a positive charge by charge of a corona charger 6. In FIG. 2(*c*) illustrating a state of a second transferring process, the voltage applied by the transfer device 21 is switched to a negative charge, so that the first and second images are transferred onto both sides of a sheet at the same time. In FIG. 2(*d*) illustrating a state of a conveying process, the sheet is conveyed to a fixing device and a cleaning operation is performed for the intermediate transfer belt 10.

Further, an image forming apparatus of JP publication No. 2000-105513 includes two developing devices containing developer having different polarities. Further, the polarity of a voltage to be applied to a transfer roller, provided inside of a loop of an intermediate transfer belt at a position where contacting each other, is changeable. When transferring a first image (positively charged) from a photoconductor to the intermediate transfer belt (first transferring), a transfer voltage of a negative polarity is applied to the transfer roller. Then, the transfer voltage is changed to a positive polarity, so that the first image (positively charged) is transferred onto the first side of a sheet and at the same time the second image (negatively charged) is transferred from the photoconductor onto the second side of the sheet (second transferring).

In each of the above image forming apparatuses, although the charging polarities of toner images are made different from each other, the polarity of a transfer voltage must be switched between the first transferring and the second transferring, which complicates the mechanism and the control of transfer voltage switching.

SUMMARY OF THE INVENTION

The present invention has been made in view of the above-discussed and other problems, and addresses the above-discussed and other problems.

Preferred embodiments of the present invention provide a novel image forming apparatus and a novel image forming method that fix toner images transferred onto both sides of a sheet without disturbing the images, thereby avoiding deterioration of the images. The preferred embodiments of the present invention further provide a novel image forming apparatus and a novel image forming method that transfer images onto both sides of a sheet with a relatively simple mechanism and a relatively simple control and that avoid disturbing the images transferred onto the sheet. The preferred embodiments of the present invention further provide a novel image forming apparatus and a novel image forming method using a novel heat-resisting transfer belt that enables stable transfer, sheet conveyance and fixing operations so that satisfactory image quality can be obtained.

According to a preferred embodiment of the present invention, an image forming apparatus includes a first image bearing member, a second image bearing member, and a fixing device. A first visual image formed on the first image bearing member is transferred onto the second image bearing member to be transferred from the second image bearing member onto a first side of a recording medium, and a second visual image formed on the first bearing member is transferred from the first image bearing member onto a second side of the recording medium, so that the visual images are obtained on the first and second sides of the recording medium respectively. The visual images on the first and second sides of the recording medium are fixed by the fixing device in a state that the second image bearing member and the recording medium are overlapped with each other.

According to another preferred embodiment of the present invention, an image forming apparatus includes a first image bearing member, a second image bearing member, a fixing device, a first transfer device configured to transfer a first visual image carried by the first image bearing member onto the second image bearing member or a second visual image carried by the first image bearing member onto a recording medium, and a second transfer device configured to transfer the first visual image carried by the second image bearing member onto the recording medium. The first visual image is transferred from the second image bearing member onto a first side of the recording medium and the second visual image is transferred from the first image bearing member onto a second side of the recording medium, so that the visual images are obtained on the first and second sides of the recording medium respectively, and the visual images on the first and second sides of the recording medium are fixed by the fixing device in a state that the second image bearing member and the recording medium are overlapped with each other.

According to another preferred embodiment of the present invention, an image forming apparatus of electrophotography, comprising includes a first image bearing member having a photoconductive property, a developing device configured to visualize an image on the first image bearing member into a toner image, a second image bearing member configured to carry thereupon the toner image transferred from the first image bearing member; and a fixing device. A first toner image formed on the first image bearing member is transferred onto the second image bearing member to be transferred from the second image bearing member onto a first side of a recording medium, and a second toner image formed on the first image bearing member is transferred onto a second side of the recording medium, so that the toner images are obtained on the first and second sides of the recording medium respectively. The toner images on the first and second sides of the recording medium are fixed by the fixing device in a state that the second image bearing member and the recording medium are overlapped with each other.

The above image forming apparatuses may further include a charging device, and after the first visual image formed on the first image bearing member is transferred from the first image bearing member onto the second image bearing member, a charging polarity of the first visual image is reversed on the second image bearing member by the charging device, so that the first and the second visual images are transferred onto the first and second sides of the recording medium at a same time.

In the above image forming apparatuses, the second image bearing member may be shaped in a form of an endless belt, and the endless belt second image bearing member may have a heat-resisting property against heat of 150–300° C. and a volume resistivity of $10^6$–$10^{12}\Omega\cdot$cm, and may be formed in two layers including a substrate member and a surface layer.

According to still another preferred embodiment of the present invention, an image forming apparatus includes a first image bearing member, a second image bearing member, a charging device, and a fixing device. A first image formed on the first image bearing member is transferred onto the second image bearing member, a second image is formed on the first image bearing member, the first and second images are transferred onto both sides of a recording medium at a same time, and the recording medium is conveyed to a fixing area of the fixing device by the second image bearing member, and after the first image is transferred from the first image bearing member onto the second image bearing member, a charging polarity of the first image is reversed on the second image bearing member by the charging device so that the first and the second images are transferred onto the both sides of the recording medium at the same time.

According to still another preferred embodiment of the present invention, an image forming apparatus includes a first image bearing member, and a second image bearing member. A first visual image transferred from the first image bearing member onto the second image bearing member is transferred onto a first side of a recording medium and a second visual image is transferred from the first image bearing member onto a second side of the recording medium, so that the visual images are formed on the first and second sides of the recording medium. The second image bearing member includes a heat-resisting transfer belt having a heat-resisting property against heat of 150–300° C. and a volume resistivity of $10^6$–$10^{12}\Omega\cdot$cm and formed in two layers including a substrate member and a surface layer.

According to another preferred embodiment of the present invention, a transfer belt for use in an image forming apparatus has a heat-resisting property against heat of 150–300° C. In the apparatus, a first visual image transferred from a first image bearing member onto a second image bearing member is transferred onto a first side of a recording medium from the second image bearing member and a second visual image is transferred from the first image bearing member onto a second side of the recording medium, so that the visual images are formed on the first and second sides of the recording medium. The transfer belt is formed in two layers including a substrate member and a surface layer, and has a volume resistivity of $10^6$–$10^{12}\Omega\cdot$cm According to still another preferred embodiment of the present invention, an image forming method includes steps of transferring a first image formed on a first image bearing member onto a second image bearing member, transferring a second image formed on the first image bearing member onto a second side of a recording medium, transferring the first image from the second image bearing member to a first side of the recording medium, and fixing the first and second images on the first and second sides of the recording medium in a state that the second image bearing member and the recording medium are overlapped with each other.

The above method may further include a step of reversing a charging polarity of the first image on the second image bearing member. In this case, the transferring of the second image formed on the first image bearing member onto the second side of a recording medium and the transferring of the first image from the second image bearing member to the first side of the recording medium are performed at a same time.

According to still another preferred embodiment of the present invention, an image forming method includes steps of transferring a first image formed on a first image bearing member onto a second image bearing member, reversing a polarity of the first image on the second image bearing member, transferring the first image on the second image bearing member onto a first side of a recording medium and a second image formed on the first image bearing member onto a second side of the recording medium at a same time, and conveying the recording medium to a fixing area of a fixing device by the second image bearing member.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1A:
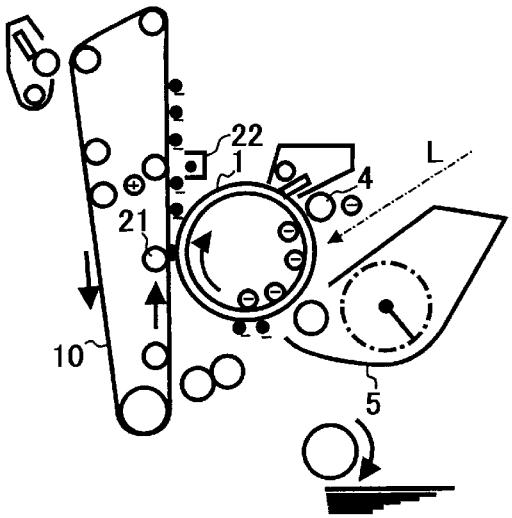
FIG. 1A BACKGROUND ART
FIGS. 1(*a*)–1(*d*) are schematic drawings for explaining background processes of transferring toner images onto both sides of a sheet in an image forming apparatus.
Figure 1B:
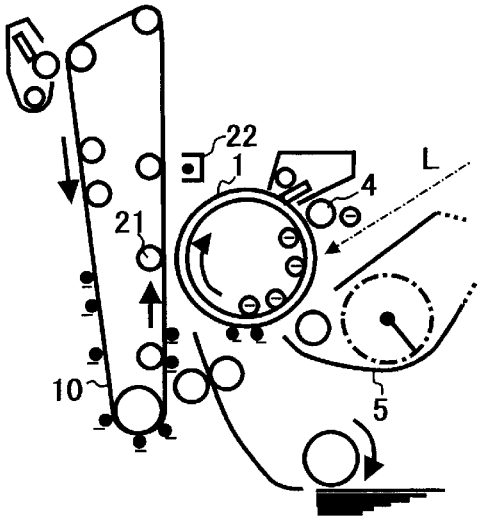
FIG. 1B BACKGROUND ART
Figure 1C:
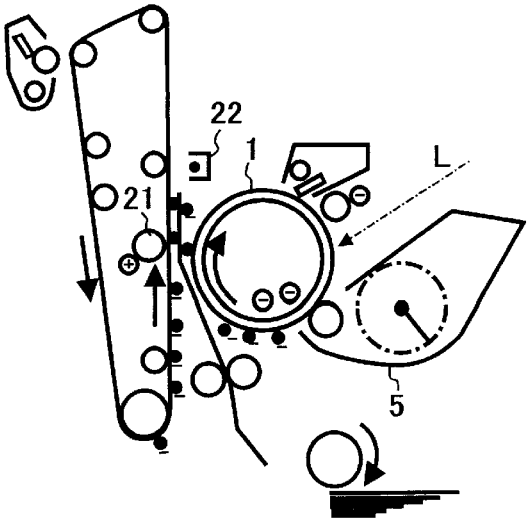
FIG. 1C BACKGROUND ART
Figure 1D:
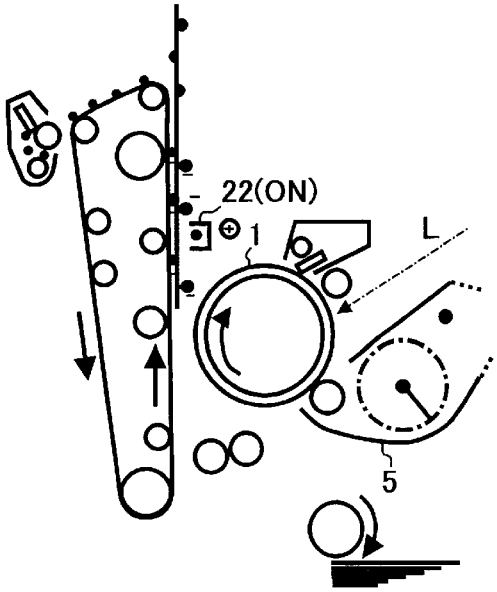
FIG. 1D BACKGROUND ART
Figure 2A:
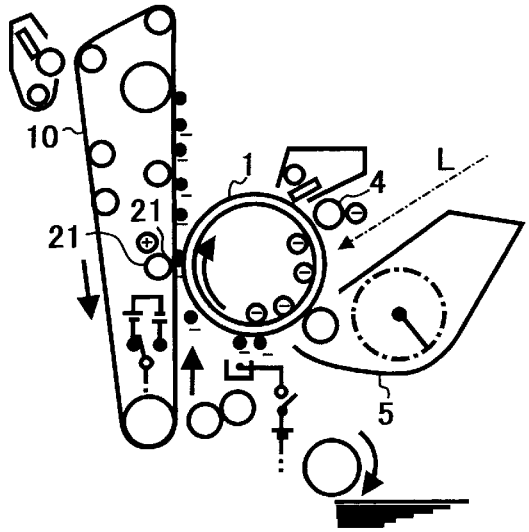
FIG. 2A BACKGROUND ART
FIGS. 2(*a*)–2(*d*) are schematic drawings for explaining background processes of transferring images onto both sides of a sheet in an image forming apparatus.
Figure 2B:
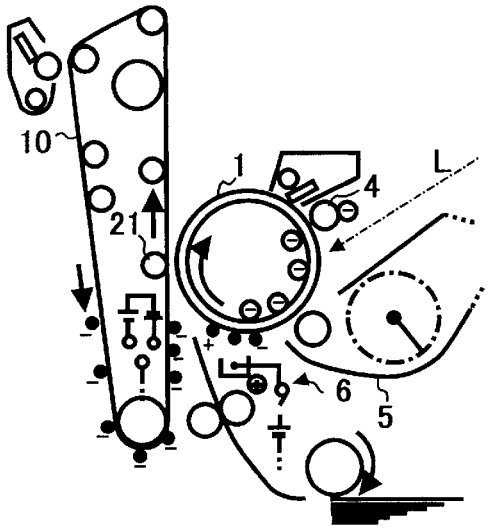
FIG. 2B BACKGROUND ART
Figure 2C:
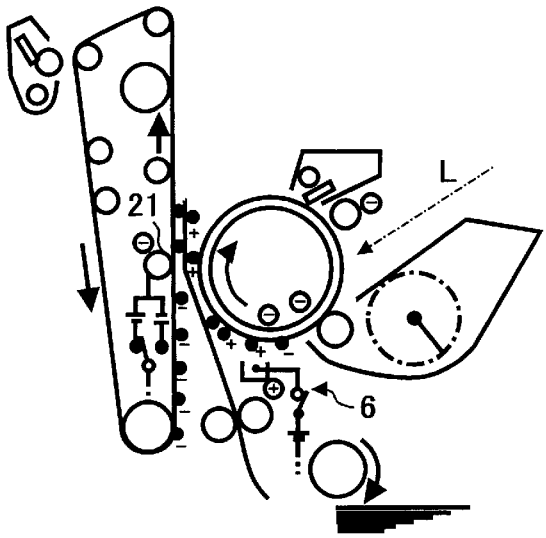
FIG. 2C BACKGROUND ART
Figure 2D:
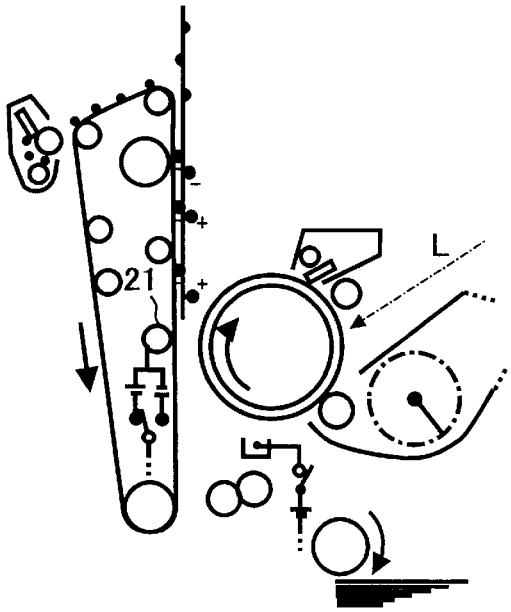
FIG. 2D BACKGROUND ART

Referring now to the drawings, wherein like reference numerals designate identical or corresponding parts throughout the several views, preferred embodiments of the present invention are described.

Figure 3:
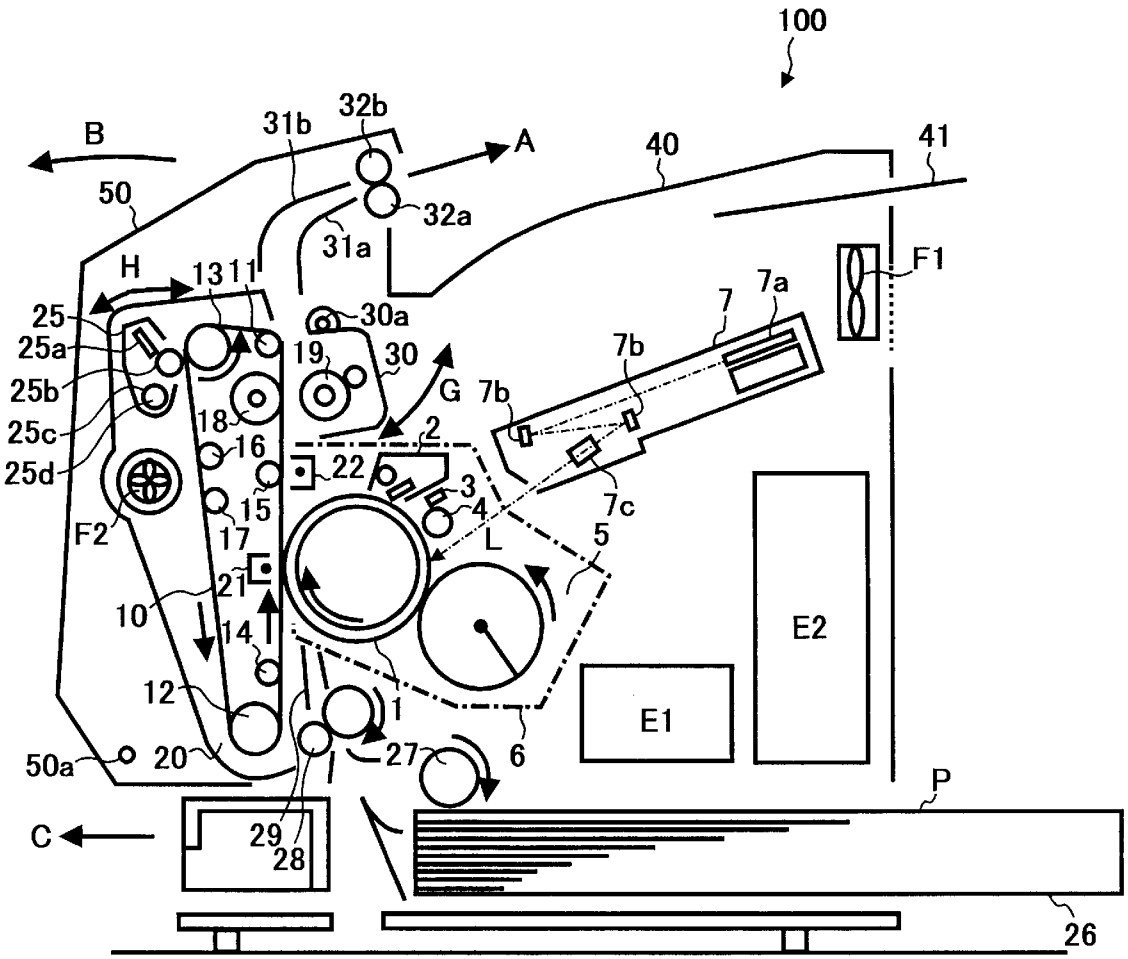
FIG. 3 is a cross section illustrating a printer as an example of an image forming apparatus according to a preferred embodiment of the present invention.

FIG. 3 is a cross section illustrating a printer as an example of an image forming apparatus according to a preferred embodiment of the present invention.

A printer 100 includes a process cartridge 6 incorporating a photoconductor drum 1 serving as a first image bearing member substantially at a center thereof. A cleaning device 2, a discharging device 3, a charging device 4 and a developing device 5 are arranged around the photoconductor drum 1. An exposure device 7 is arranged above and at the right side of the process cartridge 6 in FIG. 1. A laser light L emitted by the exposure device 7 irradiates the photoconductor drum 1 at a writing position between the charging device 4 and the developing device 5.

A belt unit 20 is arranged at the left side of the process cartridge 6 in FIG. 3. The belt unit 20 includes an intermediate transfer belt 10 serving as a second image bearing member. The photoconductor drum 1 is arranged so that a part thereof contacts the intermediate transfer belt 10.

The intermediate transfer belt 10 is spanned around and supported by rollers 11, 12, and 13, so as to be rotatable in a counterclockwise direction in FIG. 3. In the embodiment, the roller 13 functions as a driving roller. The intermediate transfer belt 10 is spanned around the rollers 11, 12, and 13 such that a winding angle is obtained relative to the driving roller 13, and thereby a driving force is securely transmitted to the driving roller 13. The driving roller 13 includes, on its outer circumferential surface, a rubber material such as urethane, which has a superior heat-resisting property Rubber material can obtain a resisting force relative to the intermediate transfer belt 10, so that slippage between the driving roller 13 and the intermediate transfer belt 10 is prevented when the driving roller 13 is driven. The intermediate transfer belt 10 is heat-resisting and has a resistance value that enables transfer of toner. Preferably, polyimide or polyamide is used as a substrate of the intermediate transfer belt 10.

Rear-side supporting rollers 14 and 15, cooling devices 16 and 17, a fixing roller 18, and a first transfer device 21 are arranged inside of a loop of the intermediate transfer belt 10.

The fixing roller 18 includes a heat source such as a heater inside thereof, and fixes a toner image, which has been transferred onto a first side of a sheet, onto the sheet. The first transfer device 21 is arranged so as to oppose the photocounductor drum 1 while sandwiching the intermediate transfer belt 10 therebetween. The first transfer device 21 transfers a toner image formed on the photoconductor drum 1 onto the intermediate transfer belt 10 or onto the first surface of the sheet. Each of the rollers arranged inside of the loop of the intermediate transfer belt 10 is grounded to a frame of the printer 100.

A second transfer device 22, a fixing device 30 and a belt cleaning device 25 are arranged around the outer circumference of the intermediate transfer belt 10. The fixing device 30 includes a fixing roller 19 having a heat source such as a heater inside thereof, and fixes a toner image, which has been transferred onto a second side of the sheet, onto the sheet. The fixing device 30 is supported so as to be rotatable around a fulcrum 30*a*. The fixing device 30 is rotated in a direction indicated by an arrow G by a rotating device (not shown), so as to be pressed against the fixing roller 18 while sandwiching the intermediate transfer belt 10 and a sheet therebetween, and to be separated from the fixing roller 18.

The belt cleaning device 25 for the intermediate transfer belt 10 includes a cleaning roller 25*a*, a blade 25*b*, and a toner conveying device 25*c*. The belt cleaning device 25 removes unnecessary toner remaining on a surface of the intermediate transfer belt 10. Toner deposited in the cleaning device 25 is conveyed to a collecting device (not shown) by the toner conveying device 25*c*. The cleaning device 25 is rotatable in a direction indicated by an arrow H around a rotating fulcrum 25*d*. The cleaning device 25 is rotated by a device (not shown) so that the cleaning roller 25*a* is brought into contact with or separated from the intermediate transfer belt 10.

In the embodiment, as illustrated in FIG. 3, the first and second transfer devices 21 and 22 are arranged at one side of the intermediate transfer belt 10 (at a side at the right side in FIG. 3). The intermediate transfer belt 10 is configured in the embodiment by the position of the driving roller 13 and the rotation direction of the intermediate transfer belt 10, so that a side of the intermediate transfer belt 10, that contacts the photoconductor drum 1, i.e., a side where a transfer area is located, is a stretched part of the belt 10. Therefore, even when an outer force is unnecessarily given to the intermediate transfer belt 10, the intermediate transfer belt 10 is stably driven at the transfer area, and thereby undesired trouble such as image blurring is avoided.

The process cartridge 6 is constructed by integrally assembling the photoconductor drum (first image bearing member) 1, the cleaning device 2, the discharging device 3, the charging device 4 and the developing device 5. The process cartridge 6 can be replaced when its expected life span ends. In the embodiment of FIG. 3, the belt unit 20 and the fixing device 30 are also configured so as to be replaced when their respective life spans end. A front frame 50 of the main body of printer 100 can be opened in a direction indicated by an arrow B around an open/close support axis 50*a* so that replacement work for the process cartridge 6 etc. and clearing work for a jammed sheet are facilitated.

A sheet feeding cassette 26 is arranged at a bottom part of the main body of the printer 100. The sheet feeding cassette 26 can be drawn out in a direction indicated by an arrow C. Transfer sheets P as recording media are accommodated in the sheet cassette 26. A feeding roller 27 is arranged above a tip end side (at a left side end in FIG. 3) of the sheet feeding cassette 6 in a sheet feeding direction. Further, a registration roller pair 28 is arranged below the photoconductor drum 1. A guide member 29 is arranged so as to guide a sheet P from the registration roller 28 to a transfer position. An electronic unit E1 and a control unit E2 are arranged above the sheet feeding cassette 26 and at a right side part of the main body of the printer 100. A fan F1 is arranged above the control unit E2 for discharging inside air so as to prevent inside temperature from rising.

A sheet discharging and stacking part 40 is formed at an upper surface of the main body. An auxiliary device 41 is arranged at an end of the discharging/stacking part 40 so as to be th drawn out and pushed back into the main body. Discharging rollers 32*a* and 32*b* are arranged at an uppermost position of the printer 100 so as to discharge a sheet passed through a fixing operation onto the discharging/stacking part 40. Further, guide plates 31*a* and 31*b* are arranged so as to guide a sheet separated from the intermediate transfer belt 10 to the discharging rollers 32*a* and 32*b*.

Next, an image forming operation in the above-described embodiment is described. First, an operation for obtaining images on both sides of a sheet is described. In the description of obtaining images on both sides of a sheet, an image which is first formed is referred to as a first side image, and an image which is later formed is referred to as a second side image. Further, a sheet side onto which the first side image is transferred is referred to as a first sheet side and a sheet side onto which the second side image is transferred is referred to as a second sheet side.

As described above, the image forming apparatus of the embodiment is a printer, in which a signal for writing an image is sent from a host computer (not shown). The exposure device 7 is driven according to an image signal which has been received. Light from a laser light source (not shown) of the exposure device 7 is deflected so as to scan by a polygon mirror 7*a* which is rotated by being driven by a motor. The light is irradiated onto the photoconductor drum 1 which has been uniformly charged by the charging device 4 via a mirror 7*b* and a fθ lens 7*c* etc., so that an electrostatic latent image corresponding to writing information is formed on the photoconductor drum 1.

The latent image on the photoconductor drum 1 is developed by the developing device 5 so that a visual image of toner is formed and carried on a surface of the photoconductor drum 1 as a first side image. The first side toner image on the photoconductor drum 1 is transferred by the first transfer device 21, which is provided at a rear side of the intermediate transfer belt 10 functioning as a second image bearing member, onto a surface of the intermediate transfer belt 10 which is being moved in synchronism with the photoconductor drum 1. The surface of the photoconductor drum 1 is then cleaned of residual toner by the cleaning device 2 and discharged by the discharging device 3 for a subsequent image forming cycle.

The intermediate transfer belt 10 carries the first side toner image transferred thereupon and is driven in the counterclockwise direction in FIG. 3. At this time, so that the toner image on the intermediate transfer belt 10 is not disturbed, the second transfer device 22, the fixing device 30 and the cleaning device 25 are controlled so as to be in non-operated states respectively (i.e., so that each power input thereto is cut off or so as to be separated from the intermediate transfer belt 10).

When the intermediate transfer belt 10 is conveyed so that the toner image thereupon is moved to a predetermined position, a second side image starts to be formed on the photoconductor drum 1 by the above-described process, and sheet feeding starts. By rotation of the feeding roller 27 in the associate arrow direction in FIG. 3, an uppermost sheet P in the sheet feeding cassette 26 is fed out from the sheet feeding cassette 26 to be conveyed to the registration roller pair 28.

The intermediate transfer belt 10 is moved in synchronism with the photoconductor drum 1, so that the first side image transferred on the intermediate transfer belt 10 is moved one cycle to be conveyed to a position where the intermediate transfer belt 10 and the photoconductor drum 1 contact each other.

The second side image on the photoconductor drum 1 is first transferred by the first transfer device 21 onto a second side of the sheet P which has been conveyed into a between the intermediate transfer belt 10 and the photoconductor drum 1 via the registration roller pairs 28. The sheet P is conveyed by the registration roller pair 28 at an appropriate timing such that the positions of the sheet P and the second side image on the photoconductor drum 1 correctly meet with each other. The positions of the sheet P and the first side image on the intermediate transfer belt 10 also correctly meet with each other.

While the second side image on the photoconductor drum 1 is being transferred onto the second side of the sheet P, the other side (first side) of the sheet P is in close contact with and is moved together with the first side image on the intermediate transfer belt 10. When the sheet P passes an acting area of the second transfer device 22, a voltage is applied to the second transfer device 22 and thereby the second side image on the intermediate transfer belt 10 is transferred onto the sheet.

The sheet onto which the toner images have been transferred on both sides thereof by the actions of the first and second transfer devices 21 and 22 is conveyed to a fixing area of the fixing device 30 as the intermediate transfer belt 10 is rotated. At the fixing area, the fixing device 30 is rotated so that the fixing roller 19 is pressed against and into contact with the fixing roller 18 while sandwiching the intermediate transfer belt 10 therebetween. Thereby, the toner images on both sides of the sheet P is fixed at one time by cooperative work of the fixing roller 19 and the fixing roller 18.

After transfer of the toner images onto both sides of the sheet P, the sheet P is conveyed without being separated from the intermediate transfer belt 10 in a state that the sheet P and the intermediate transfer belt 10 are overlapped with each other, and the toner images are fixed onto the sheet P in such a state. Therefore, the toner images are not disturbed and thereby image blurring is prevented. Further, because the sheet P is conveyed to the fixing area while the sheet P is carried on the intermediate transfer belt 10, the sheet conveying path from the transfer area to the fixing area can be made vertical. Thereby, effective use of an internal space of the printer 100 is enabled, which contributes to reduction of the size of the printer 100. Further, because the fixing area can be arranged above the photoconductor drum 1, the photoconductor drum 1 can be prevented from being affected by heat from the fixing area, and the heat can be advantageously discharged outside of the main body.

The sheet P after passing the fixing area is separated from the intermediate transfer belt 10 at a sheet separation part at the roller 11, and is discharged via the guide members 31*a* and 31*b* to the discharging/stacking part 40 by the discharging roller pair 32*a* and 32*b*. In the embodiment, so that the sheet P is easily separated from the intermediate transfer belt 10 by curvature thereof at the sheet separation part, the radius of the roller 11 used at the sheet separation part is made small and at the same time the intermediate transfer belt 10 is bent about 90° at the roller 11.

The intermediate transfer belt 10 may be spanned around the rollers 11, 12 and 13 so as to turn less than 90° at the separation part, i.e., at the roller 11, as illustrated in FIGS. 8(*a*)–8(*d*). By thus configuring the intermediate transfer belt 10, the sheet separation performance can be further enhanced.

Further, because the sheet separation part is located near the fixing device 30 and downstream thereof in the sheet conveying direction, the sheet P is separated from the intermediate transfer belt 10 before the temperature of toner heated by the fixing device 30 falls. Thereby, good sheet separation is realized.

When the sheet discharging/stacking part 40 is configured as illustrated in FIG. 3, a sheet is discharged to the discharging/stacking part 40 with a side of the sheet on which an image is later formed, i.e., an image which is directly transferred from the photoconductor drum 1 to the sheet, positioned faced down. Therefore, in order to stack sheets carrying images on both sides of the sheets in a correct order of pages on the discharging/stacking part 40, an image of the second page of an original must be first formed so as to be transferred onto the intermediate transfer belt 10, and thereafter, an image of the first page of the original is formed so as to be directly transferred from the photoconductor drum 1 onto the sheet. Accordingly, in order to stack sheets carrying images on both sides of the sheets in a correct order of pages on the discharging/stacking part 40, the first side image must be an image of the second page of an original and the second side image must be an image of the first page of the original. Namely, when an image exists on an even-numbered page of an original, the image on the even-numbered page is first formed so as to be transferred onto the intermediate transfer belt 10, and thereafter an image on the preceding odd-numbered page is formed so as to be directly transferred from the photoconductor drum 1 onto the sheet.

When a mirror image is formed on the photoconductor drum 1 and the image is directly transferred onto a sheet, the image is obtained as a correct image on the sheet. When an image formed on the photoconductor drum 1 is once transferred onto the intermediate transfer belt 10 and is then transferred onto a sheet, if the image is formed on the photoconductor drum 1 as a mirror image, the image is obtained on the sheet as the mirror image. Therefore, in the embodiment, the exposure is performed such that the first side image, which is transferred from the intermediate transfer belt 10 to a sheet, is formed on the photoconductor drum 1 as a correct image, and the second side image, which is directly transferred from the photoconductor drum 1 onto the sheet, is formed as a mirror image on the photoconductor drum 1.

The above-described order of image formation for obtaining correctly arranged pages can be realized by a known technology to store image data in a memory. Exposure switching between correct image and mirror image formations can be also realized by a known image processing technology.

The cleaning device 25 separated from the intermediate transfer belt 10 is rotated, after an image is transferred from the intermediate transfer belt 10 to a sheet, such that the cleaning roller 25*a* of the cleaning device 25 contacts the intermediate transfer belt 10. Residual toner on the intermediate transfer belt 10 is moved onto the cleaning roller 25 and then scraped off the cleaning roller 25 by the blade 25*a*. The scraped off toner is then collected by the toner conveying device 25*c* to be conveyed to an accommodation part (not shown). The above-described residual toner, which has been heated by the fixing rollers 18 and 19, is easy to be moved to the cleaning roller 25 before the residual toner is cooled. Therefore, the above cleaning is preferably performed upstream of the cooling devices 16 and 17. Iron, stainless or aluminum is preferable for the cleaning roller 25*b*. A thin plate member of steel or stainless may be used for the blade 25*a*.

The intermediate transfer belt 10 passed the cleaning area of the cleaning device 25 is cooled by the operation of the cooling devices 16 and 17. The cooling devices 16 and 17 may use various heat radiating systems. For example, when an air circulating system is used, air is preferably circulated after toner images on the intermediate transfer belt 10 are transferred onto a sheet so that the toner images on the intermediate transfer belt 10 are not disturbed by the air. Also, a cooling system using a heat pipe can be used, in which the heat pipe directly contacts the internal surface of a loop of the intermediate transfer belt 10 to absorb heat therefrom. The heat thus absorbed from the intermediate transfer belt 10 is discharged out of the main body of the printer 100. In FIG. 3, a fan F2 is arranged at the left side the cooling devices 16 and 17 to discharge the heat from the belt unit 20.

Figure 4:
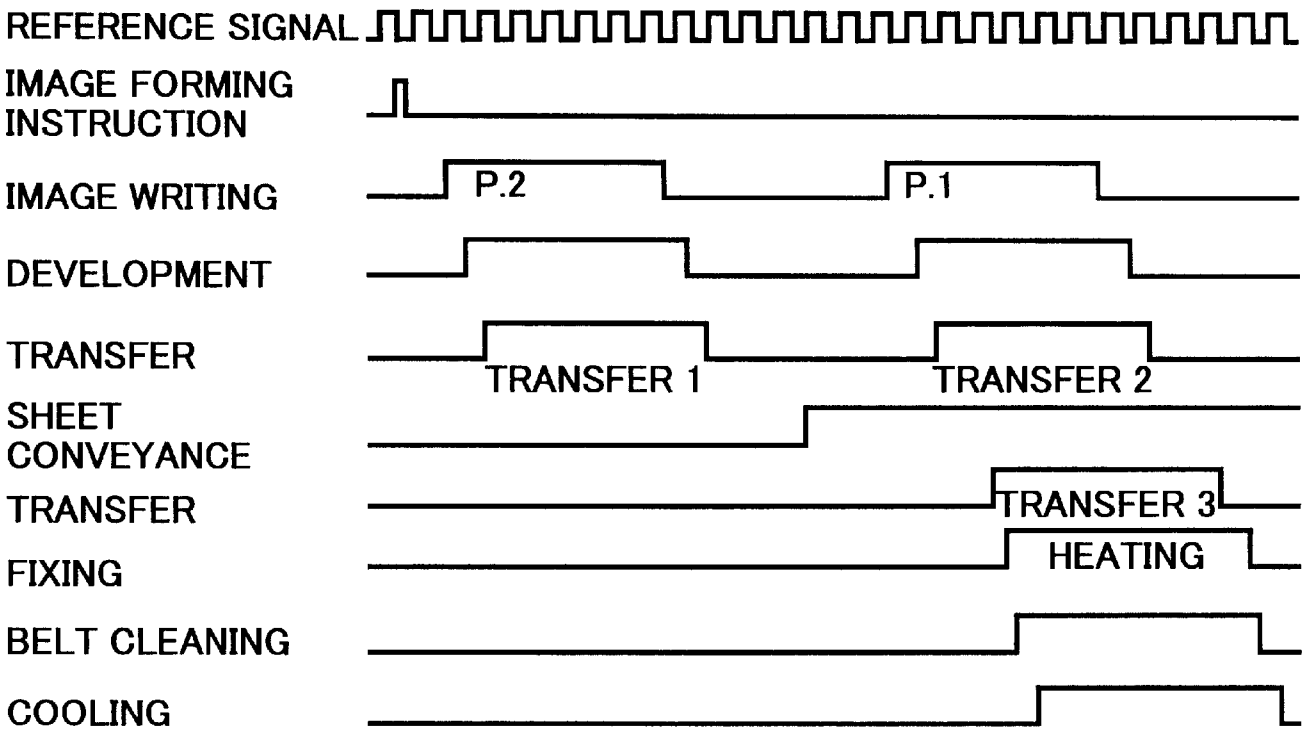
FIG. 4 is a timing chart illustrating operation timings of the printer when obtaining images on both sides of a sheet.

FIG. 4 is a timing chart illustrating operation timings of the printer 100 when obtaining images on both sides of a sheet. In FIG. 4, after an image forming instruction is given, image writing for an image of a second page (the first side image) is performed, and then development and transfer of the image to the intermediate transfer belt 10 (transfer 1) are performed. Subsequently, a sheet is fed out by the registration roller 28, and image writing, development and direct transfer to the sheet (transfer 2) of an image of the first page (the second side image) are preformed. Further, the first side image is transferred from the intermediate transfer belt 10 to the first side of the sheet (transfer 3), and the fixing rollers 18 and 19 are heated to fix the toner images on both sides of the sheet at one time. Then, cleaning of the intermediate transfer belt 10 is performed, and also cooling of the intermediate transfer belt 10 is performed. Because the images are formed in the order of second page, first page, then fourth page, third page, and so on, the images are stacked in order of pages. Thus, the sheets are correctly sorted in order of pages when taken out of the discharging/stacking part 40.

Next, an operation of the printer 100 when obtaining an image on one side of a sheet is described.

When obtaining an image on one side of a sheet, a transfer process to transfer a toner image onto the intermediate transfer belt 10 is omitted, and the toner image formed on the photoconductor drum 1 is directly transferred onto a sheet. When forming an image on one side of a sheet, a toner image on the photoconductor drum 1 is a mirror image, which turns into a correct image when transferred onto the sheet.

In FIG. 3, a sheet P is conveyed into a position between the photoconductor drum 1 and the intermediate transfer belt 10 in synchronism with a toner image formed on the photoconductor drum 1, and the toner image is transferred by the first transfer device 21 onto the sheet P from the photoconductor drum 1. The second transfer device 22 is not operated, and the sheet P is moved together with the intermediate transfer belt 10, so that the toner image is fixed onto the sheet P by the fixing device 30. Thereafter, the sheet P is separated from the intermediate transfer belt 10, and is then discharged in the direction A, via the guide members 31*a* and 31*b* and the discharging roller pair 32, so as to be stacked in the discharging/stacking part 40 with the side of the sheet P carrying the image faced down. Thus, when images of multiple pages of an original document are processed in order of pages starting with the first page, the sheets P on which toner images of the images of the multiple pages of the original document are carried are in order of pages when the sheets P are taken out of the discharging/stacking part 40.

Figure 5:
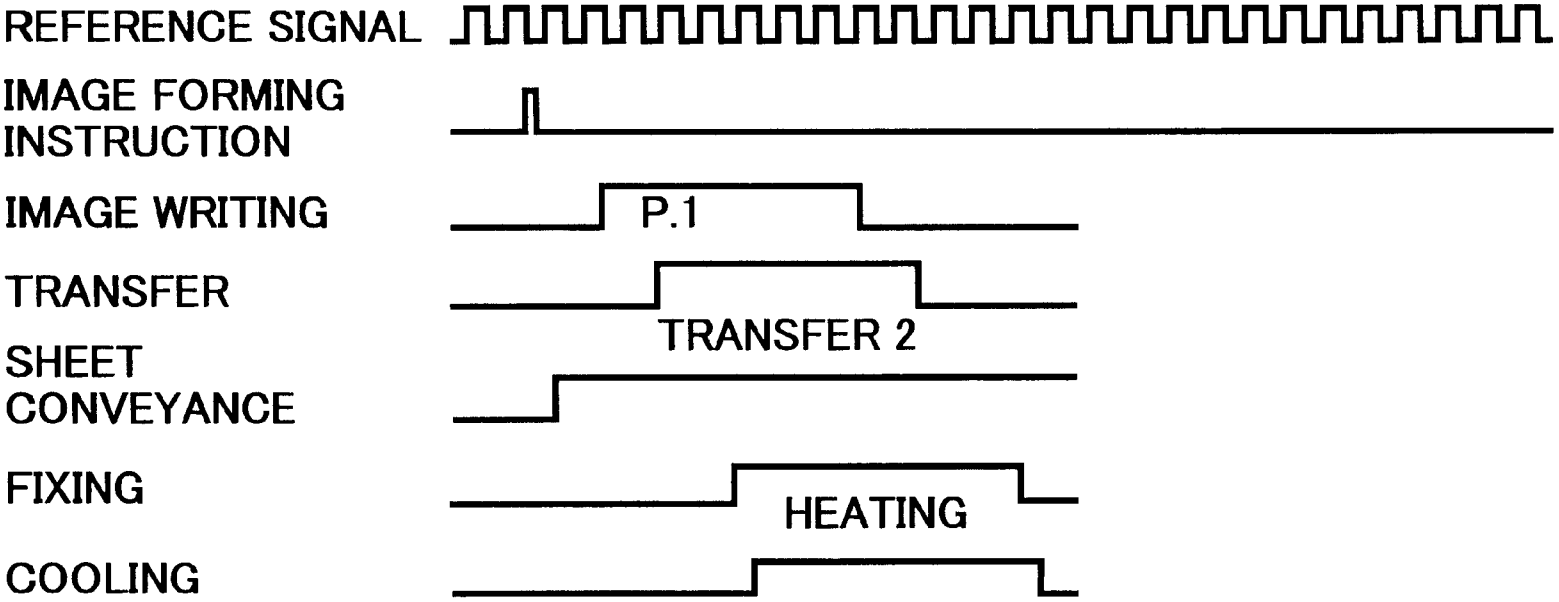
FIG. 5 is a timing chart illustrating operation timings of the printer 100 when forming an image on one side of a sheet.

FIG. 5 is a timing chart illustrating operation timings of the printer 100 when forming an image on one side of a sheet. In FIG. 5, after an image formation instruction is given, a sheet P is fed out by the registration roller 28. Then, image writing for an image of the first page is performed, and subsequently, development (not shown) and direct transfer of the image to the sheet P (transfer 2) are performed. The fixing rollers 18 and 19 are heated so as to fix the toner image onto the sheet. Further, cleaning of the intermediate transfer belt 10 (not shown) is performed, and cooling of the intermediate transfer belt 10 is also performed. When the second and subsequent pages exist, substantially the same operation as the one for the first page is repeated.

Figure 6:
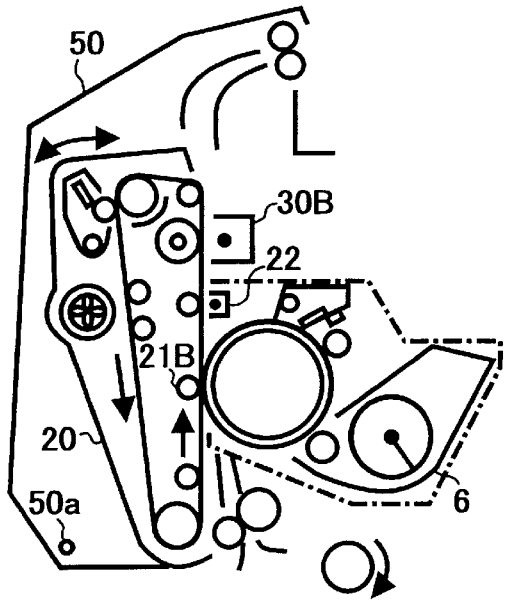
FIG. 6 is a cross section illustrating an image forming apparatus according to another preferred embodiment of the present invention, in which a first transfer device is configured to be a contact type and a fixing device is configured to be a non-contact type.

FIG. 6 is a cross section illustrating an image forming apparatus according to another preferred embodiment of the present invention, in which the first transfer device 21 is configured to be a contact type and the fixing device 30 is configured to be a non-contact type.

In this embodiment, the first transfer device 21 is configured to be a roller type device which contacts the intermediate transfer belt 10, i.e., a transfer roller 21B. The transfer roller 21B presses the intermediate transfer belt 10 against the photoconductor drum 1 from the inside of a loop of the intermediate transfer belt 10. The fixing device 30B is a non-contact type which does not contact a sheet being conveyed. The fixing device 30B fixes a toner image by irradiation of an infrared or xenon lamp. Because the fixing device 30B is a non-contact type, the fixing device 30B does not need to be rotatable, and therefore in the embodiment, is fixed.

The construction of the printer 100 is substantially the same as that of FIG. 3 except the first transfer device 21 and the fixing device 30*b*. Also, the image forming operation is substantially the same as in the previous embodiment, and therefore the description thereof is omitted. Because the fixing device 30B is a non-contact type, the fixing device 30B does not operate to contact and separate from the intermediate transfer belt 10 as in the previous embodiment.

Figure 7:
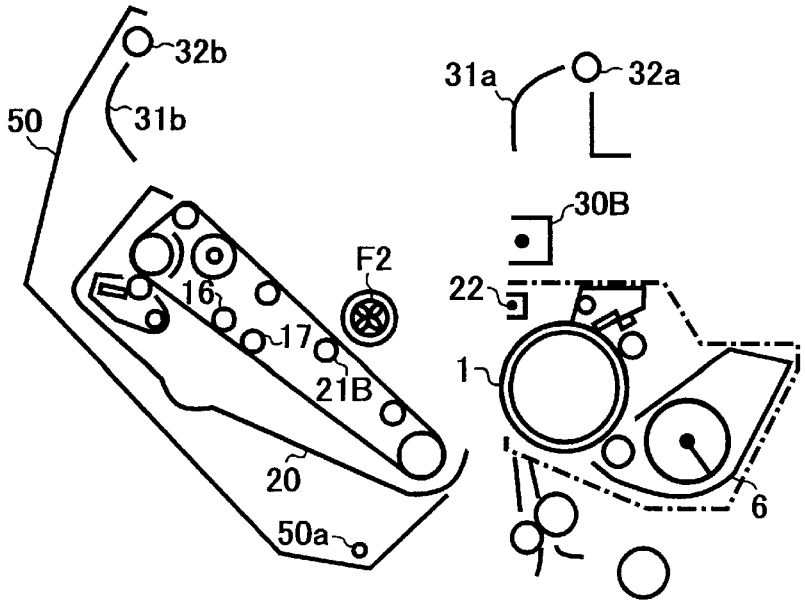
FIG. 7 is a cross section illustrating a state of the printer 100 when a front frame in which a belt unit is incorporated is opened.
Figure 8A:
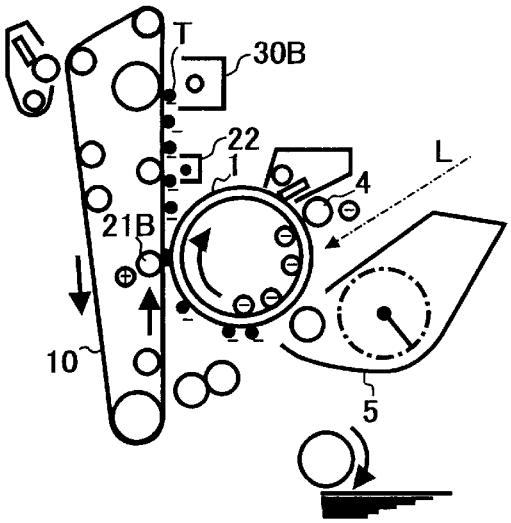
FIGS. 8(*a*)–8(*d*) are cross sections conceptually illustrating image forming processes of the printer of FIG. 6 when recording images on both sides of a sheet.
Figure 8B:
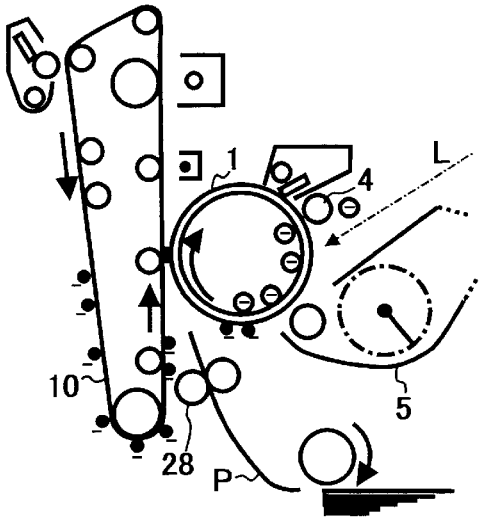
Figure 8C:
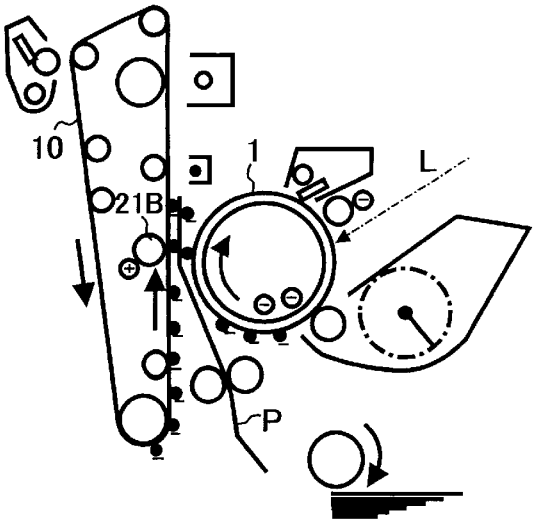
Figure 8D:
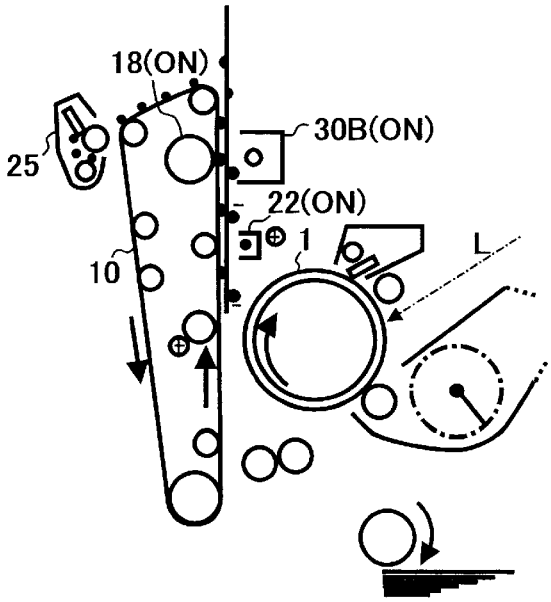
Figure 9A:
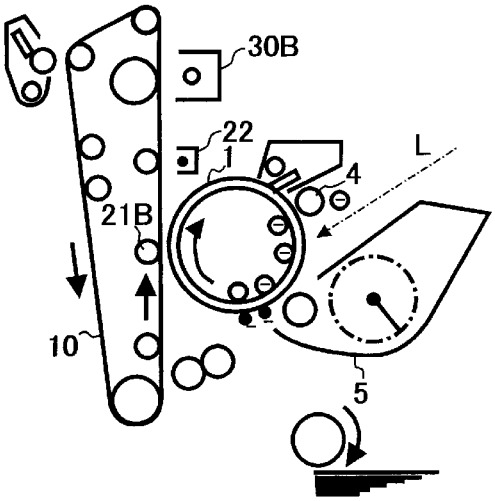
FIGS. 9(*a*)–9(*d*) are cross sections conceptually illustrating image forming processes of the printer 100 of FIG. 6 when recording an image on one side of a sheet.
Figure 9B:
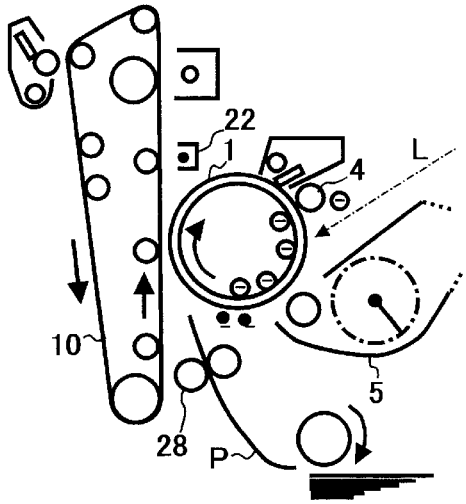
Figure 9C:
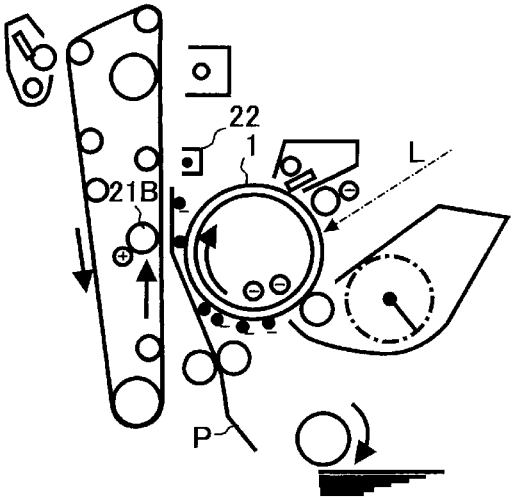
Figure 9D:
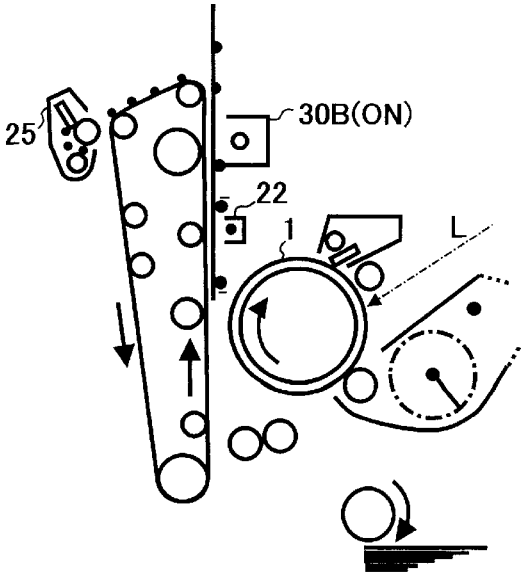

FIG. 7 is a cross section illustrating a state of the printer 100 when the front frame 50 in which the belt unit 20 is incorporated is opened. As in the embodiment illustrated in FIG. 3, the front frame 50 is configured to be rotatable around the open/close support axis 50*a*, and can be opened when removing a jammed sheet or when performing a maintenance work.

As illustrated in FIG. 7, when the front frame 50 is opened, the belt unit 20 is separated from the photoconductor drum 1, the second transfer device 22, and the fixing device 30B (in the embodiment of FIG. 3, the fixing device 30). Further, the guide plate member 31*b* and the discharging roller 32*b* are each separated from the guide plate member 31*a* and the discharging roller 32*a*. Thereby, a sheet conveying path is opened, so that removing of a jammed sheet and maintenance work are facilitated. The fan F2 which is used for cooling the intermediate transfer belt 10 in cooperation with the cooling devices 16 and 17 is provided to a frame separate from the front frame 50. In a state that the front frame 50 is closed, the fan F2 and the cooling device 16 and 17 cooperate with each other to perform a cooling function. In the embodiment of FIG. 3 also, the state that the front frame 50 is opened is substantially the same as illustrated in FIG. 7.

In the printer 100 according to each of the above-described embodiments illustrated in FIGS. 3 and 7, the image forming condition as to whether to perform image formation for one side or both sides of a sheet is determined by inputting a predetermined command from a host computer (not shown) or an operation panel (not shown) of the printer 100. Alternatively, instead of inputting the command, the printer 100 can control the image formation condition by previously setting a default condition specifying the priority between one side recording or both sides recording.

When the image forming condition is thus selected, the printer 100 controls the fixing condition of the fixing devices 18 and 30 (30B) according to the selection. When both side recording in which toner images are transferred onto both sides of a sheet is selected, because the energy required for fixing the images is larger than when one side recording is selected, the printer 100 increases the input voltage to the heat source or increases the frequency of inputting the voltage into the heat source.

In particular, when fixing an image formed on one side of a sheet, the printer 100 decreases or stops the pressure of the fixing device 18 to press the internal circumference of the intermediate transfer belt 10. The fixing device 18 which is inside of a loop of the intermediate transfer belt 10 and the fixing device 30 (30B) which is outside of the loop may preferably be configured so that respective temperatures can be individually controlled. Thereby, energy consumption in the fixing operation can be conveniently decreased.

More concretely, in one side recording, the temperature of the fixing device 30 (30B) is controlled to be within a range of 160–180° C., and the fixing roller 18 is not heated. In both side recording, the temperature of the fixing device 30 (30B) is controlled to be within a range of 160–180° C., and the temperature of the fixing roller 18 is controlled to be within a range of 180–190° C. In both side recording, the temperature of the fixing roller 18 which is inside the loop of the intermediate transfer belt 10 is higher than that of the fixing device 30 (30B) which is outside of the loop, because the sheet is heated via the intermediate transfer belt 10. Further, in both side recording, the temperature of the fixing device 30 (30B) can be lower than in one side recording because of an effect of the heat of the fixing roller 18. The above-described condition of the temperatures of the fixing devices 18 and 30 (30B) are just examples, and can be appropriately set according to the characteristics of toner used, the material and the thickness of the intermediate transfer belt 10 and other conditions.

Further, though not shown in the figures, a temperature detect device may be arranged near each of the fixing devices 18 and 30 (30B) or the intermediate transfer belt 100, so that each of the fixing devices 18 and 30 (30) or the cooling devices, e.g., the fan F2, can be controlled according to a detect output of the temperature detect device. For example, when the temperature is too high according to the detect result of the temperature detect device, the pressing of the fixing devices 18 against the intermediate transfer belt 10 is decreased or the cooling by the cooling devices 16 and 17 and the fan F2 is increased.

Furthermore, when a thin recording medium is used, the temperature range for controlling the fixing devices 18 and 30 (30B) may be made lower than when a thick recording medium is used, so that the energy consumption can be decreased.

FIGS. 8(*a*)–8(*d*) are cross sections conceptually illustrating image forming processes of the printer 100 of FIG. 6 when recording images on both sides of a sheet. FIG. 8(*a*) illustrates processes of first developing (of the first side image) and a first transferring (of the first side image to the intermediate transfer belt 10), FIG. 8(*b*) illustrates a process of second development (of the second side image), FIG. 8(*c*) illustrates a process of second transferring (of the second side image to a sheet), and FIG. 8(*d*) illustrates a process of third transferring (of the first side image to the sheet), fixing and belt cleaning. For convenience, in each of FIGS. 8(*a*)–8(*d*), the photoconductor drum 1 and the intermediate transfer belt 10 are illustrated separated from each other, however, the photoconductor drum 1 and the intermediate transfer belt 10 are arranged so as to contact each other.

In FIG. 8(*a*), the charging device 4 negatively charges the photoconductor drum 1, and negatively charged toner (illustrated in a black circle) is applied by the developing device 5 to an electrostatic latent image of a first side image formed on the photoconductor drum 1 by a writing light L from the exposure device 7. Further, the toner image of the first side image is transferred onto the intermediate transfer belt 10 by the action of the first transfer device 211B to which a positive voltage is applied.

In FIG. 8(*b*), a toner image of the second side image, which is negatively charged, is formed on the photoconductor drum 1, and the first side toner image carried on the 1, intermediate transfer belt 10 is near a contacting part between the photoconductor drum 1 and the intermediate transfer belt 10 after making one round. Further, a sheet P is fed out by the registration roller 28 in such a timing as to be correctly positioned relative to the images.

In FIG. 8(*c*), the second side image on the photoconductor drum 1, which is negatively charged, is transferred onto the sheet P (second transferring) by the action of the first transfer device 21B to which a positive voltage is applied. At this time, the first side of the sheet P is overlapped with the first side image on the intermediate transfer belt 10. In the embodiment, a belt having an intermediate resistivity is used for the intermediate transfer belt 10 serving as the second image bearing member, and the sheet P is therefore held by the intermediate transfer belt 10 by a natural electric charge opposing an electric charge of the sheet P. Therefore, a bias voltage is not applied.

In FIG. 8(*d*), the first side toner image on the intermediate transfer belt 10, which has been negatively charged, is transferred onto the sheet P (second transferring) by the action of the second transfer device 22 to which a positive voltage is applied. Further, the sheet P is conveyed to the fixing area while being held on the intermediate transfer belt 10, and the toner images are fixed onto both sides of the sheet P by turning on heating of the fixing devices 18 and 30 (30B) which are arranged on both sides of the sheet P. The belt cleaning device 25 is pressed against the intermediate transfer belt 10 to remove residual toner on the intermediate transfer belt 10.

FIGS. 9(*a*)–9(*d*) are cross sections conceptually illustrating image forming processes of the printer 100 of FIG. 4 when recording an image on one side of a sheet. FIG. 9(*a*) illustrates processes of exposure and developing (of an image), FIG. 9(*b*) illustrates a process of feeding a sheet P, FIG. 9(*c*) illustrates a process of transferring (of the image) and FIG. 9(*d*) illustrates a process of fixing and belt cleaning. For convenience, in each of FIGS. 9(*a*)–9(*d*), the photoconductor drum 1 and the intermediate transfer belt 10 are illustrated separated from each other, however, the photoconductor drum 1 and the intermediate transfer belt 10 are arranged so as to contact each other.

In FIG. 9(*a*), the charging device 4 negatively charges the photoconductor drum 1, and negatively charged toner is applied by the developing device 5 to an electrostatic latent image formed on the photoconductor drum 1 by a writing light L from the exposure device 7.

In FIG. 9(*b*), a sheet P is fed out by the registration roller 28 in such a timing as to be correctly positioned relative to the toner image on the photoconductor drum 1. In FIG. 9(*c*), the toner image on the photoconductor drum 1 is transferred onto the sheet P by the action of the first transfer device 21B to which a positive voltage is applied.

In FIG. 9(*d*), the sheet P is conveyed to the fixing area while being held on the intermediate transfer belt 10, and the toner image is fixed onto the sheet P by turning on heating of the fixing device 30B. Further, the belt cleaning device 25 is pressed against the intermediate transfer belt 10 to remove residual toner on the intermediate transfer belt 10.

Now, other embodiments of the present invention are described, in which the present invention is applied to color image forming apparatuses.

Figure 10:
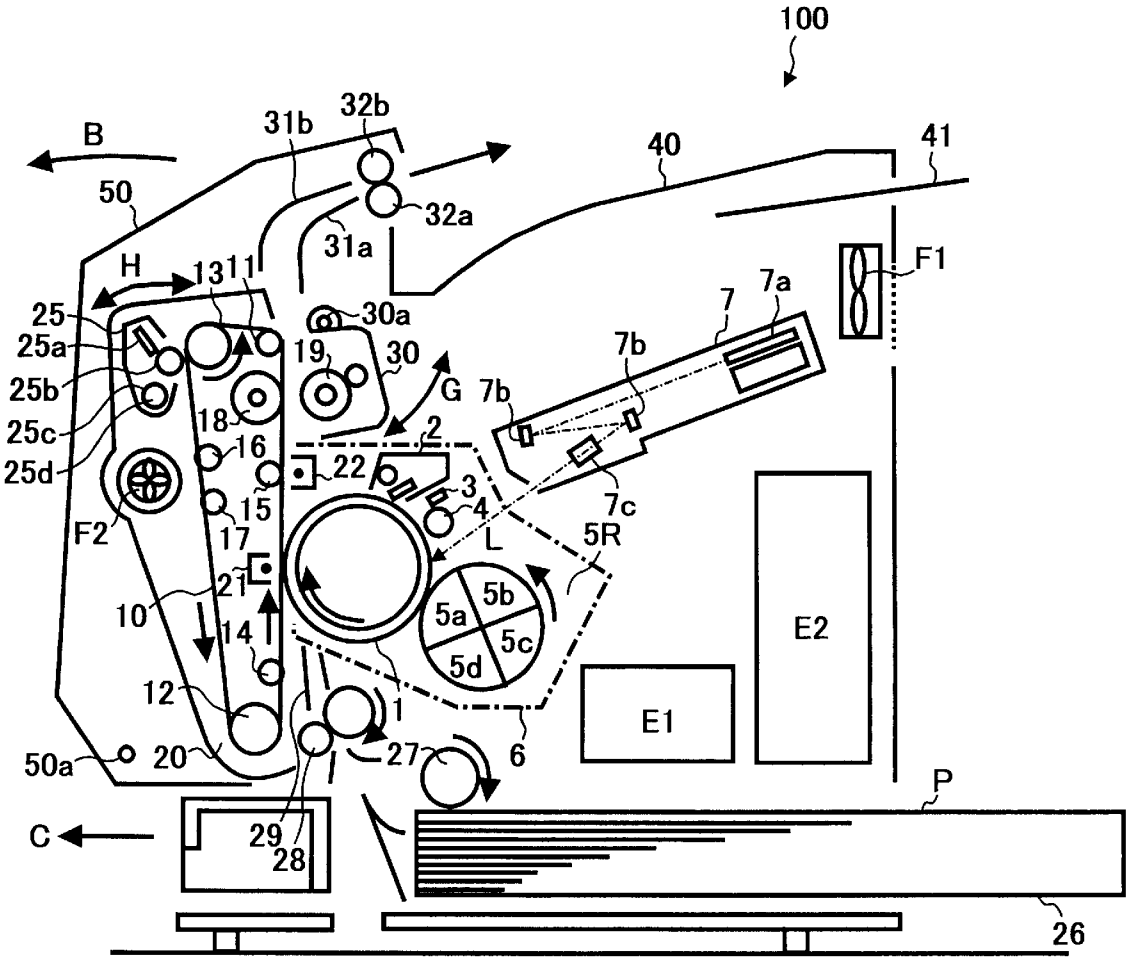
FIG. 10 is a cross section illustrating a color image forming apparatus according to another preferred embodiment of the present invention, in which a revolver type developing apparatus is used.
Figure 11:
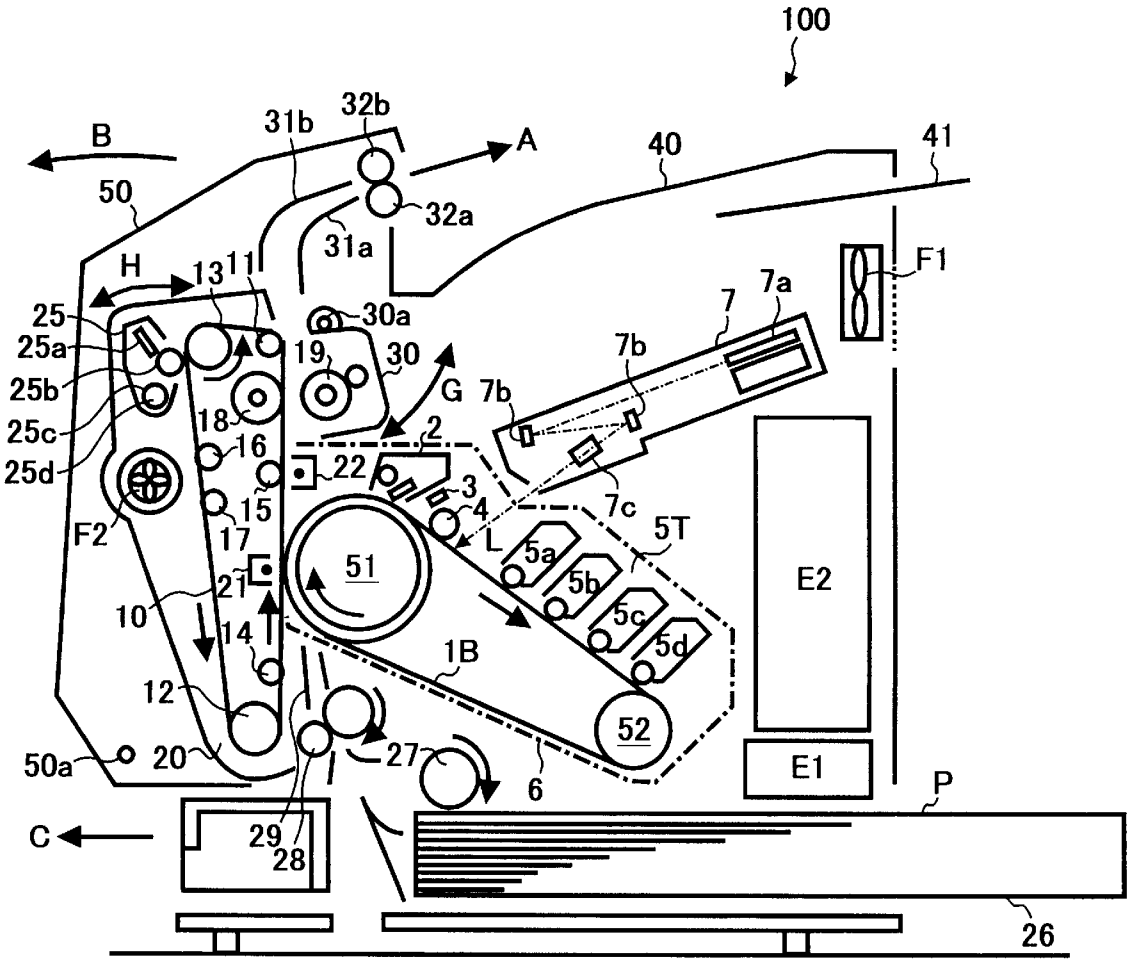
FIG. 11 is a cross section illustrating a color image forming apparatuses according to another preferred embodiment of the present invention, in which a tandem type developing apparatus is arranged at one side of a photoconductor belt.

FIG. 10 and FIG. 11 are cross sections illustrating the color image forming apparatuses according to the embodiments. The printer 100 of FIG. 10, as an example of the color image forming apparatus, includes a revolver type developing apparatus 5R, and the printer 100 of FIG. 11 includes a tandem type developing apparatus 5T arranged at one side of a photoconductor belt 1B. In the embodiments, the intermediate transfer belt 100 is configured so as to contact and separate from the photoconductor drum 1 or the photoconductor belt 1B. The other parts of the printer 100 are substantially the same as in the printer 100 of FIG. 3, and therefore the description thereof will be omitted.

In FIG. 10, the revolver type developing apparatus 5R includes developing devices 5*a*–5*d*, and is driven to rotate in the counterclockwise direction indicated by the associated arrow of FIG. 10, so that each of the developing devices 5*a*–5*d* is switched to move to a developing position to develop a latent image formed on the photoconductor drum 1. The developing devices 5*a*–5*d* respectively contain toner of different colors for realizing full color development. For example, the developing device 5*a* contains yellow toner, the developing device 5*b* contains magenta toner, the developing device 5*c* contains cyan toner, and the developing device 5*d* contains black toner. When forming an image in black, the developing device 5*d* containing the black toner is moved to the developing position so as to perform the developing operation as in the previous embodiments.

When forming an image in full color, in a state that the photoconductor drum 1 is separated from the intermediate transfer belt 10, optical information to be developed with the yellow toner is written by the exposure device 7 on the surface of the photoconductor drum 1 which has been charged, so that a corresponding latent image is formed thereupon. The yellow toner is then applied to the latent image by the developing device 5*a* for yellow moved to the developing position. In a similar manner, a magenta image is formed on the photoconductor drum 1 so as to be superimposed with the yellow image. Further, a cyan image is formed to be superimposed with the previous images on the photoconductor drum 1. Lastly, a black image is superimposed with the previously formed images, so that a color image of four colors is formed and carried on the surface of the photoconductor drum 1. The photoconductor drum 1 rotates four times in forming a color image of four colors.

After forming the color image of four colors on the surface of the photoconductor drum 1, the intermediate transfer belt 10 is brought into contact with the photoconductor drum 1, and the color image on the photoconductor drum 1 is transferred by an action of the first transfer device 21 onto a sheet P conveyed by the registration roller 28 in an appropriate timing.

When forming images on both sides of the sheet P, after a first side image is formed on the surface of the photoconductor drum 1, the photoconductor drum 1 and the intermediate transfer belt 10 are brought into contact with each other, and the first side image is transferred onto the intermediate transfer belt 10, that is moving, by an action of the first transfer device 21. The intermediate transfer belt 10 carrying thereupon the first side image is separated from the photoconductor drum 1 at a predetermined position, and is stopped to wait there. Then, a second side image starts to be formed on the photoconductor drum 1. After a color image of the second side image is formed on the photoconductor drum 1, the intermediate transfer belt 10 starts to be conveyed so that the leading edge of the second side image on the photoconductor drum 1 and that of the first side image on the intermediate transfer belt 10 correctly meet with each other, and the intermediate transfer belt 10 is brought into contact with the photoconductor drum 1. At this time, the sheet P is conveyed in the appropriate timing so as to correctly meet with the first side and second side images. The second side image on the photoconductor drum 1 is transferred onto the second side of the sheet P by the action of the first transfer device 21, and the first side image on the intermediate transfer belt 10 is transferred onto the first side of the sheet P by the action of the second transfer device 22. The sheet P carrying color images on both sides thereof is then conveyed to the fixing area of the fixing device 30 in the state that the sheet P and the intermediate transfer belt 10 are overlapped with each other. The fixing operation and subsequent operations are substantially the same as in the previous embodiments and therefore the description thereof is omitted.

In FIG. 11, the photoconductor belt IB is rotatably spanned around rollers 51 and 52, and the tandem type developing apparatus device 5T including four developing devices 5*a*–5*d* is arranged along an upper side of the photoconductor belt 1B. The developing devices 5*a*–5*d* are respectively configured to individually move to developing positions near the photoconductor belt 1B and positions separated from the photoconductor belt 1B. The developing devices 5*a*–5*d* respectively contain toner of different colors for realizing full color 1 development. For example, the developing device 5*a* contains yellow toner, the developing device 5*b* contains magenta toner, the developing device 5*c* contains cyan toner, and the developing device 5*d* contains black toner. When forming an image in black, the developing device 5*d* containing the black toner is moved to the developing position so as to perform the developing operation as in the previous embodiments.

The operation of the printer 100 of FIG. 11 when forming a full color image is substantially the same as in the printer 100 of FIG. 10. While the intermediate transfer belt 1B is being rotated four times, each of the developing devices 5*a*–5*d* is brought into contact with the photoconductor belt 1B, so that images of respective colors are superimposed with each other on the intermediate transfer belt 1B to be formed into a full color image. The other aspects of the printer 100 of FIG. 11 are substantially the same as in the printer 100 of FIG. 10, and therefore the description thereof is omitted.

Now, description will be made with respect to a feature of the present invention in transferring of images onto both sides of a recording medium.

Figure 12:
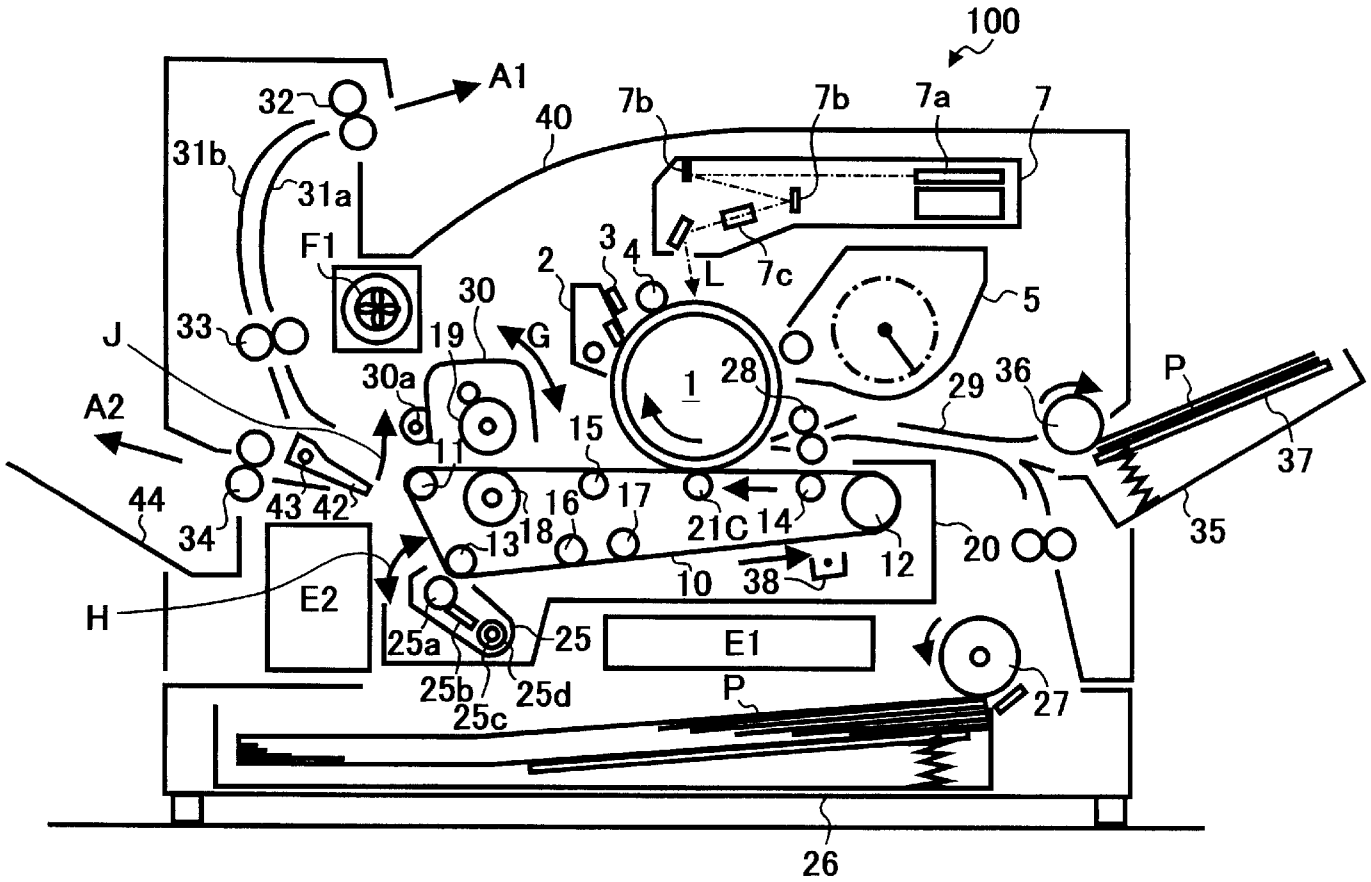
FIG. 12 is a cross section of a printer as an example of an image forming apparatus according to another embodiment of the present invention.
Figure 13A:
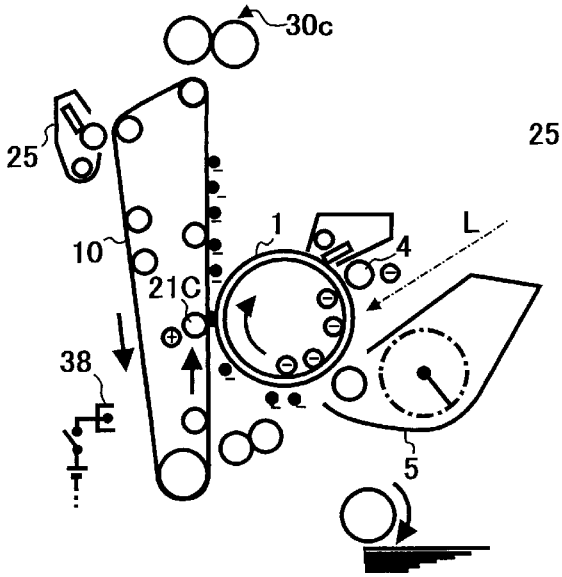
FIGS. 13(*a*)–13(*d*) are cross sections conceptually illustrating image forming processes of the printer of FIG. 12 when recording images on both sides of a sheet.
Figure 13B:
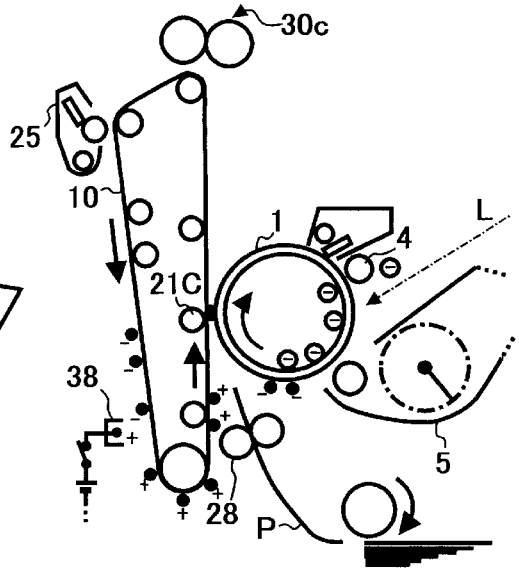
Figure 13C:
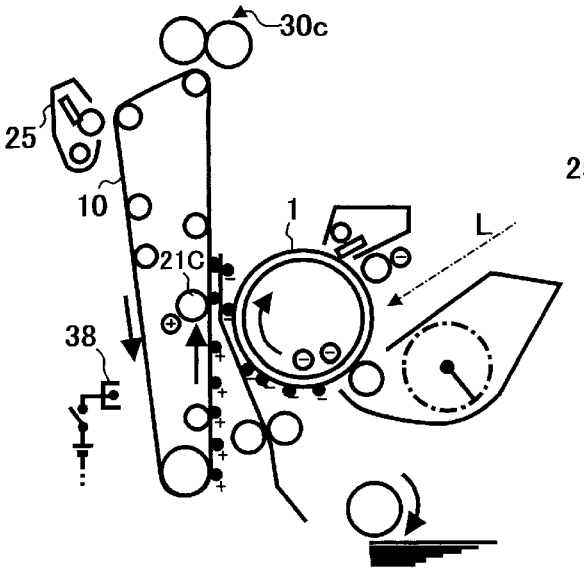
Figure 13D:
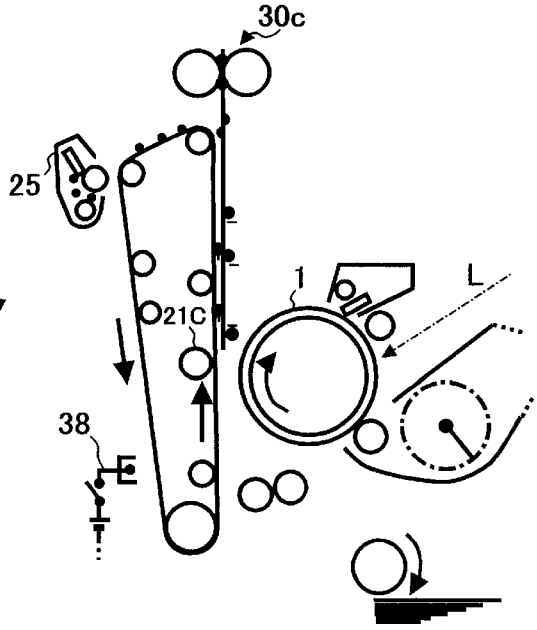
Figure 14A:
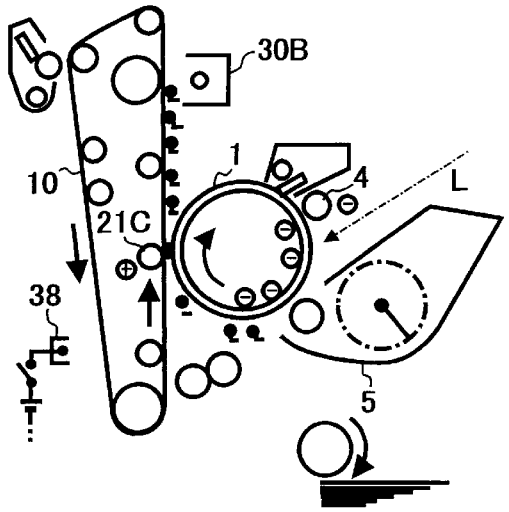
FIGS. 14(*a*)–14(*d*) are cross sections conceptually illustrating image forming processes of the printer of FIG. 12 having a differently configured fixing device, when recording images on both sides of a sheet.
Figure 14B:
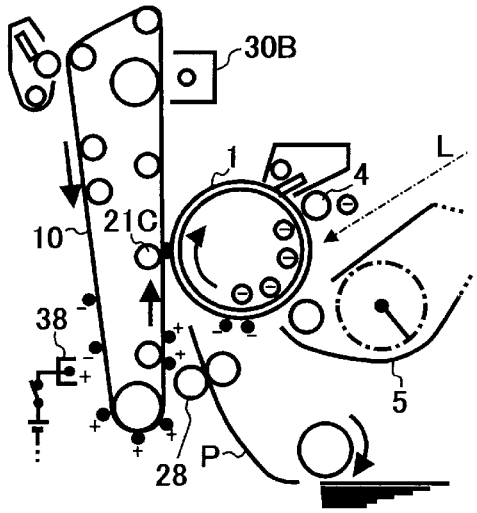
Figure 14C:
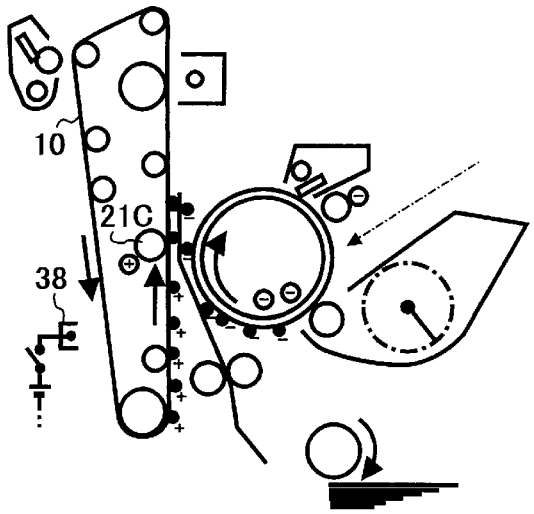
Figure 14D:
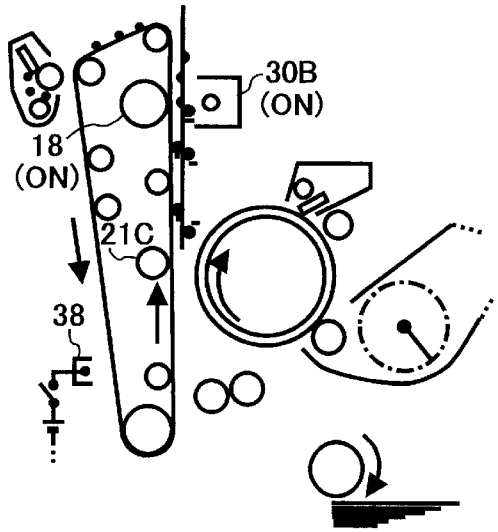

FIG. 12 is a cross section of a printer as an example of an image forming apparatus according to another preferred embodiment of the present invention.

A printer 100 includes a photoconductor drum 1 serving as a first image bearing member substantially at a center of the printer. A cleaning device 2, a discharging device 3, a charging device 4 and a developing device 5 are arranged around the photoconductor drum 1. An exposure device 7 is arranged above the photoconductor drum 1 in FIG. 12. A laser light L emitted by the exposure device 7 irradiates the photoconductor drum 1 at a writing position between the charging device 4 and the developing device 5.

A belt unit 20 is arranged below the photoconductor drum 1 in FIG. 12. The belt unit 20 includes as the main component thereof an intermediate transfer belt 10 serving as a second image bearing member. The photoconductor drum 1 is arranged so that a part thereof contacts the intermediate transfer belt 10. The intermediate transfer belt 10 is spanned around and supported by rollers 11, 12, and 13, so as to be rotatable in a counterclockwise direction in FIG. 12. The intermediate transfer belt 10 is heat-resisting and has a resistance value that enables transfer of toner.

Rear-side supporting rollers 14 and 15, cooling devices 16 and 17, a fixing roller 18, and a transfer device 21C are arranged inside of a loop of the intermediate transfer belt 10. The fixing roller 18 includes a heat source such as a heater inside thereof, and fixes a toner image, which has been transferred onto a first side of a sheet, onto the sheet. The transfer device 21C is arranged so as to oppose the photoconductor drum 1 while sandwiching the intermediate transfer belt 10 therebetween. The transfer device 21 C transfers a toner image formed on the photoconductor drum 1 onto the intermediate transfer belt 10 or onto the first side of the sheet from the intermediate transfer belt 10. The transfer device 21C further transfers a toner image formed on the photoconductor drum 1 directly onto the second side of the sheet.

A fixing device 30, a belt cleaning device 25 and a charging device 38 are arranged around the outer circumference of the intermediate transfer belt 10. The charging device 38 reverses a polarity of toner transferred onto the intermediate transfer belt 10. The fixing device 30 includes a fixing roller 19 having a heat source such as a heater inside thereof, and fixes the toner image, which has been transferred onto the second side of the sheet, onto the sheet. The fixing device 30 is supported so as to be rotatable around a fulcrum 30*a*. The fixing device 30 is rotated in a direction indicated by an arrow G by a rotating device (not shown), so as to be pressed against the fixing roller 18 while sandwiching the intermediate transfer belt 10 and a sheet therebetween, and to be separated from the fixing roller 18.

The belt cleaning device 25 for the intermediate transfer belt 10 includes a cleaning roller 25*a*, a blade 25*b*, and a toner conveying device 25*c*. The belt cleaning device 25 removes unnecessary toner remaining on a surface of the intermediate transfer belt 10. Toner deposited in the cleaning device 25 is conveyed to a collecting device (not shown) by the toner conveying device 25*c*. The cleaning device 25 is rotatable in a direction indicated by an arrow H around a rotating fulcrum 25*d*. The cleaning device 25 is rotated by a device (not shown) so that the cleaning roller 25*a* is brought into contact with or separated from the intermediate transfer belt 10.

In the embodiment, the photoconductor drum (first image bearing member) 1, the cleaning device 2, the discharging device 3, the charging device 4, and the developing device 5 are assembled into a unit so as to be a process cartridge. The process cartridge can be replaced when its expected life span ends.

A sheet feeding cassette 26 is arranged at a bottom part of the main body of the printer 100. The sheet feeding cassette 26 can be drawn out in a direction toward a right side of FIG. 12. Transfer sheets P as recording media are accommodated in the sheet cassette 26. A feeding roller 27 is arranged above a tip end side (at a right side end in FIG. 12.) of the sheet feeding cassette 6 in a sheet feeding direction. Further, a registration roller pair 28 is arranged at the right side of the photoconductor drum 1. A guide member 29 is arranged so as to guide a sheet P from the feeding roller 27 to the registration roller 28. An electronic unit E1 and a control unit E2 are arranged above the sheet feeding cassette 26. Further, a manual sheet feeding tray 35 is arranged at a right side plate of the main body, and a feeding roller 36 feeds out sheets P set on a sheet setting table 37.

A switching claw 42 is provided at the left side of the belt unit 20 in FIG. 12. The claw 42 is rotatable around a fulcrum 43, so as to switch a conveying direction of a sheet P conveyed from the belt unit 20 to a discharging/stacking part 40 provided at an upper surface of the main body or to a discharging tray 44 provided at a side plate of the main body. When the claw 42 is positioned as illustrated in FIG. 12, the sheet P is conveyed to the discharging/stacking part 40, and when the claw 42 is switched to a direction J, the sheet P is conveyed to the discharging tray 44.

A conveying roller pair 33 is arranged above the claw 42 to convey the sheet P. Further, a discharging roller pair 32 is arranged above the conveying roller pair 33 to discharge the sheet P to the discharging/stacking part 40. Guide members 31*a* and 31*b* are arranged between the conveying roller pair 33 and the discharging roller pair 32. Another discharging roller pair 34 is arranged left of the claw 42 to discharge the sheet P to the discharging tray 44.

Next, an image forming operation of the printer 100 configured as in the above-described embodiment is described.

First, an operation for obtaining images on both sides of a sheet is described. In the description of obtaining images on both sides of a sheet, an image which is first formed is referred to as a first side image, and an image which is later formed is referred to as a second side image. Further, a sheet side onto which the first side image is transferred is referred to as a first sheet side and a sheet side onto which the second side image is transferred is referred to as a second sheet side.

As described above, the image forming apparatus of the embodiment is a printer, in which a signal for writing an image is sent from a host computer (not shown). The exposure device 7 is driven according to an image signal which has been received. A light from a laser light source (not shown) of the exposure device 7 is deflected so as to scan by a polygon mirror 7*a* which is rotated by being driven by a motor. The light is irradiated onto the photoconductor drum 1 which has been uniformly charged by the charging device 4 via a mirror 7*b* and a fθ lens 7*c* etc., so that an electrostatic latent image corresponding to writing information is formed on the photoconductor drum 1.

The latent image on the photoconductor drum 1 is developed by the developing device 5 so that a visual image of toner is formed and carried on a surface of the photoconductor drum 1 as a first side image. The first side toner image on the photoconductor drum 1 is transferred by the transfer device 21C, which is provided at a rear side of the intermediate transfer belt functioning as a second image bearing member, onto a surface of the intermediate transfer belt 10 which is being moved in synchronism with the photoconductor drum 1. The surface of the photoconductor drum 1 is cleaned for residual toner by the cleaning device 2 and is discharged by the discharging device 3 for a subsequent image forming cycle.

The intermediate transfer belt 10 carries the first side toner image transferred thereupon and is driven in the counterclockwise direction in FIG. 12. At this time, so that the toner image on the intermediate transfer belt 10 is not disturbed, the fixing device 30 and the cleaning device 25 are controlled so as to be in non-operated states respectively (i.e., so that each power input thereto is cut off or so as to be separated from the intermediate transfer belt 10).

When the intermediate transfer belt 10 is conveyed so that the toner image thereupon is moved to a predetermined position, a second side image starts to be formed on the photoconductor drum 1 by the above-described process, and sheet feeding of a sheet P starts from a selected sheet feeding device (the sheet feeding cassette 26 or the manual feeding tray 35). By rotation of the feeding roller 27 or 36 in the arrow direction, the uppermost sheet P in the sheet feeding cassette 26 or a sheet feeding plate 37 of the manual feeding tray 35 is fed out to be conveyed to the registration roller pair 28.

The intermediate transfer belt 10 is moved in synchronism with the photoconductor drum 1, so that the first side image transferred on the intermediate transfer belt 10 is moved one cycle to be conveyed to a position where the intermediate transfer belt 10 and the photoconductor drum 1 contact each other. At this time, the polarity of the toner image carried on the intermediate transfer belt 10 is reversed by an action of the charging device 38 provided in front of the roller 12 in the moving direction of the intermediate transfer belt 10.

The sheet P is conveyed by the registration roller pair 28 at an appropriate timing such that the positions of the sheet P, the second side image on the photoconductor drum 1 and the first side image on the intermediate transfer belt 10 correctly meet with each other. The sheet P is conveyed to a transferring position where the photoconductor drum 1 and the intermediate transfer belt 10 contact each other, and the first side and the second side toner images are transferred onto both sides of the sheet P at one time by the transfer device 21C.

The sheet P onto which the toner images have been transferred onto both sides thereof is conveyed to a fixing area of the fixing device 30 as the intermediate transfer belt 10 is rotated. At the fixing area, the fixing device 30 is rotated so that the fixing roller 19 is pressed against and into contact with the fixing roller 18 while sandwiching the intermediate transfer belt 10 therebetween. Thereby, the toner images on both sides of the sheet P is fixed at one time by cooperative work of the fixing roller 19 and the fixing roller 18.

After transfer of the toner images onto both sides of the sheet P, the sheet P is conveyed without being separated from the intermediate transfer belt 10 in a state that the sheet P and the intermediate transfer belt 10 are overlapped with each other, and the toner images are fixed onto the sheet P in such a state. Therefore, the toner images are not disturbed, and image blurring is prevented.

The sheet P after passing the fixing area is separated from the intermediate transfer belt 10 at the roller 11 by curvature of the intermediate transfer belt 10. The conveying direction of the sheet P is switched by the claw 42 so that the sheet P is discharged to the discharging/stacking part 40 or the discharging tray 44.

When the sheet P is discharged to the discharging/stacking part 40, the sheet P is discharged to the discharging/stacking part 40 with a side of the sheet P on which an image is to be later formed, i.e., an image is directly transferred thereto from the photoconductor drum 1, faced down. Therefore, in order to stack the sheets P carrying images on both sides of the sheets P in a correct order of pages on the discharging/stacking part 40, an image of the second page of an original must be first formed so as to be transferred onto the intermediate transfer belt 10, and thereafter, an image of the first page of the original is formed so as to be directly transferred from the photoconductor drum 1 onto the sheet. Accordingly, in order to stack the sheets P carrying images on both sides of the sheets P in a correct order of pages on the discharging/stacking part 40, the first side image must be an image of the second page of an original and the second side image must be an image of the first page of the original.

Namely, when an image exists on an even-numbered page of an original, the image on the even-numbered page is first formed so as to be transferred onto the intermediate transfer belt 10, and thereafter an image on the preceding odd-numbered page is formed so as to be directly transferred from the photoconductor drum 1 onto the sheet.

When the sheet P is discharged to the discharging tray 44, the sheet P is discharged with the second side image, i.e., the side of the sheet P onto which an image is directly transferred from the photoconductor drum 1, faced up. Accordingly, in this case, the sheets P carrying images on both sides thereof are not stacked in a correct order pages in the discharging tray 44.

In order to stack the sheets P carrying images on both sides of the sheets P in a correct order of pages on the discharging tray 44, the first side image must be an image of a first page of an original and the second image must be a second page of the original. When an image exists on an odd-numbered page of an original, the image on the odd-numbered page is first formed so as to be transferred onto the intermediate transfer belt 10. Thereafter an image on the following even-numbered page is formed so as to be directly transferred from the photoconductor drum 1 onto the sheet. The user can designate whether to discharge the sheet P to the discharging/stacking part 40 or to the discharging tray 44 by an operation of an operation panel (not shown) of the printer 100.

When a mirror image is formed on the photoconductor drum 1 and the image is directly transferred onto a sheet, the image is obtained as a correct image on the sheet. When an image formed on the photoconductor drum 1 is once transferred onto the intermediate transfer belt 10 and is then transferred onto a sheet, if the image is formed on the photoconductor drum 1 as a mirror image, the image is obtained on the sheet as the mirror image. Therefore, in the embodiment, the exposure is performed such that the first side image, which is transferred from the intermediate transfer belt 10 to a sheet, is formed on the photoconductor drum 1 as a correct image, and the second side image, which is directly transferred from the photoconductor drum 1 onto the sheet, is formed as a mirror image on the photoconductor drum 1.

The above-described order of image formation for obtaining correctly arranged pages can be realized by a known technology to store image data in a memory. Exposure switching between correct image and mirror image formations can be also realized by a known image processing technology.

The cleaning device 25 separated from the intermediate transfer belt 10 is rotated, after images have been transferred to a sheet from the photoconductor drum 10 and the intermediate transfer belt 10, such that the cleaning roller 25*a* of the cleaning device 25 contacts the intermediate transfer belt 10. Residual toner on the intermediate transfer belt 10 is moved onto the cleaning roller 25*a*, and is then scraped off the cleaning roller 25*a* by the blade 25*b*. The scraped off toner is then collected by the toner conveying device 25*c* to be conveyed to an accommodation part (not shown).

The intermediate transfer belt 10 passed the cleaning area of the cleaning device 25 is cooled by the operations of the cooling devices 16 and 17. The cooling devices 16 and 17 may use various heat radiating systems. For example, when an air circulating system is used, air is preferably circulated after toner images on the intermediate transfer belt 10 are transferred onto a sheet so that the toner images on the intermediate transfer belt 10 are not disturbed by the air. Also, a cooling system using a heat pipe can be used, in which the heat pipe directly contacts the internal surface of a loop of the intermediate transfer belt 10 to absorb heat therefrom.

Next, an operation of the printer 100 when obtaining an image on one side of a sheet is described. When obtaining an image on one side of a sheet, a transfer process to transfer a toner image onto the intermediate transfer belt 10 is omitted, and the toner image formed on the photoconductor drum 1 is directly transferred onto the sheet. When forming an image on one side of a sheet, a toner image on the photoconductor drum 1 is a mirror image, which turns into a correct image when transferred onto the sheet.

In FIG. 12, a sheet P is conveyed into between the photoconductor drum 1 and the intermediate transfer belt 10 in synchronism with a toner image formed on the photoconductor drum 1, and the toner image is transferred by the transfer device 21C onto the sheet P from the photoconductor drum 1.

The sheet P onto which the toner image has been transferred is moved together with the intermediate transfer belt 10, so that the toner image is fixed onto the sheet P by the fixing device 30. Thereafter, the sheet P is separated from the intermediate transfer belt 10, and is then discharged, according to the direction of the claw 42, so as to be stacked in the discharging/stacking part 40 or the discharging tray 44. When the sheet P is discharged to the discharging/stacking part 40, even when images of multiple pages of an original document are processed in order of pages starting with the first page, the sheets P on which toner images of the images of the multiple pages of the original document are carried are in order of pages when the sheets P are taken out of the discharging/stacking part 40.

FIGS. 13(*a*)–13(*d*) are cross sections conceptually illustrating image forming processes of the printer 100 of FIG. 12 when recording images on both sides of a sheet. In FIGS. 13(*a*)–13(*d*), the developing device 30*c* is arranged downstream of the intermediate transfer belt 100 in the sheet feeding direction. For saving space in FIG. 13, the printer 100 is illustrated with the intermediate transfer belt 100 vertically positioned.

FIG. 13(*a*) illustrates processes of first developing (of the first side image) and a first transferring (of the first side image to the intermediate transfer belt 10), FIG. 13(*b*) illustrates a process of second development (of the second side image), FIG. 13(*c*) illustrates a process of second transferring (of the first and the second side images to both sides of a sheet), and FIG. 13(*d*) illustrates processes of fixing and belt cleaning. For convenience, in each of FIGS. 13(*a*)–13(*d*), the photoconductor drum 1 and the intermediate transfer belt 10 are illustrated separated from each other, however, the photoconductor drum 1 and the intermediate transfer belt 10 are arranged so as to contact each other.

In FIG. 13(*a*), the charging device 4 negatively charges the photoconductor drum 1, and negatively charged toner (illustrated in a black circle) is applied by the developing device 5 to an electrostatic latent image of a first side image formed on the photoconductor drum 1 by a writing light L from the exposure device 7. Further, the toner image of the first side image is transferred onto the intermediate transfer belt 10 by the action of the transfer device 21C to which a positive voltage is applied.

In FIG. 13(*b*), a toner image of the second side image, which is negatively charged, is formed on the photoconductor drum 1, and the first side toner image carried on the intermediate transfer belt 10 is conveyed to a contacting part between the photoconductor drum 1 and the intermediate transfer belt 10. On the way, the polarity of the first side toner image on the intermediate transfer belt 10 is reversed by the charging device 38 to the positive polarity. Further, a sheet P is fed out by the registration roller 28 in such a timing as to be correctly positioned relative to the first side and second side toner images on the intermediate transfer belt 10 and the photoconductor drum 1.

In FIG. 13(*c*), by the action of the transfer device 21C to which a positive charge is applied, the toner images are transferred onto both sides of the sheet P at one time. The first side toner image on the intermediate transfer belt 10, which is positively charged, is transferred onto the sheet P by electrostatic repulsion of the toner image against the transfer device 21C to which a positive voltage is applied, and the second side toner image is transferred from the photoconductor drum 1 to the sheet P by electrostatic absorption of the negatively charged toner image to the sheet P.

In FIG. 13(*d*), the sheet P is conveyed to the fixing area while being held on the intermediate transfer belt 10, and the toner images are fixed onto both sides of the sheet P by the fixing devices 30*c*. The belt cleaning device 25 is pressed against the intermediate transfer belt 10 to remove residual toner on the intermediate transfer belt 10.

Thus, according to present invention, the polarity of a toner image transferred onto (first transfer) and carried on a second image bearing member (intermediate transfer belt 10) is reversed on the second image bearing member with a non-contact type charging device (charging device 38). Thereby, it is possible to transfer toner images onto both sides of a sheet at one time (second transfer) by a single transfer device (transfer device 21C). Further, the polarity of applying voltages with the transfer device 21C needs not to be changed in the first and second transfers. Therefore, a mechanism to change the polarity of applying voltages of the transfer device 21C is not required, thus realizing advantage in cost. Furthermore, because charge is not applied from the open side of a sheet onto which a toner image has been transferred, the toner image transferred onto the second side of the sheet is not disturbed and electrostatic offsetting of the image in the fixing operation due to increase of the charge of the transfer sheet is avoided.

Further, when obtaining a toner image on one side of a sheet P, a toner image formed on the photoconductor drum 1 is directly transferred onto the one side of the sheet P. The negatively charged toner image on the photoconductor drum 1 is attracted to the sheet P by the transfer device 21C to which a positive voltage is applied.

The above-described charging polarity for the photoconductor drum 1 and the toner charging polarity are just examples, and can be reversed.

FIGS. 14(*a*)–14(*d*) are cross sections conceptually illustrating image forming processes of the printer 100 of FIG. 12 having a differently configured fixing device 30B, when recording images on both sides of a sheet. For saving space in FIG. 14, the printer 100 is illustrated with the intermediate transfer belt 100 vertically positioned.

In FIGS. 14(*a*)–14(*d*), the charging device 30B is a non-contact type charging device unlike the one in FIG. 12. The charging device 30B does not contact a sheet P being conveyed, and fixes a toner image by irradiation of light with an infrared lamp or a xenon lamp. Therefore, the charging device 30B needs not to be rotatable and is fixed. The other parts of the printer 100 are substantially the same as in the printer 100 of FIG. 12. Further, the image forming processes of the printer 100 are substantially the same as those described with reference to FIGS. 13(*a*)–13(*d*).

In each of the configurations of the printer 100 illustrated in FIG. 12 and FIGS. 14(*a*)–14(*d*), the polarity of a toner image transferred (first transfer) and carried on the a second image bearing member (intermediate transfer belt 10) is reversed by a non-contact type charging device (charging device 38) on the second image bearing member as shown in FIGS. 13(*a*)–13(*d*). Thereby, it is possible to transfer toner images onto both sides of a sheet at one time (second transfer) by a single transfer device (transfer device 21C). Further, the polarity of applying voltages with the transfer device 21C needs not to be changed in the first and second transfers. Therefore, a mechanism to change the polarity of applying voltages of the transfer device 21C is not required, thus realizing advantage in cost. Furthermore, because charge is not applied from the open side of a sheet onto which a toner image has been transferred, the toner image transferred onto the second side of the sheet is not disturbed and electrostatic offsetting of the image in the fixing operation due to increase of the charge of the transfer sheet is avoided.

In the printer 100 of FIGS. 13(*a*)–13(*d*), as in the printer 100 of FIGS. 12, after transfer of toner images onto both sides of a sheet P, the fixing operation is performed, without separating the sheet P from the intermediate transfer belt 10, in a state that the sheet P and the intermediate transfer belt 10 are overlapped with each other. Thereby, the toner image are never disturbed, and image blurring is avoided. Further, because the fixing device 30B needs not to be separated from the intermediate transfer belt 10, the mechanism and control of the fixing device 30B can be simple.

Figure 15:
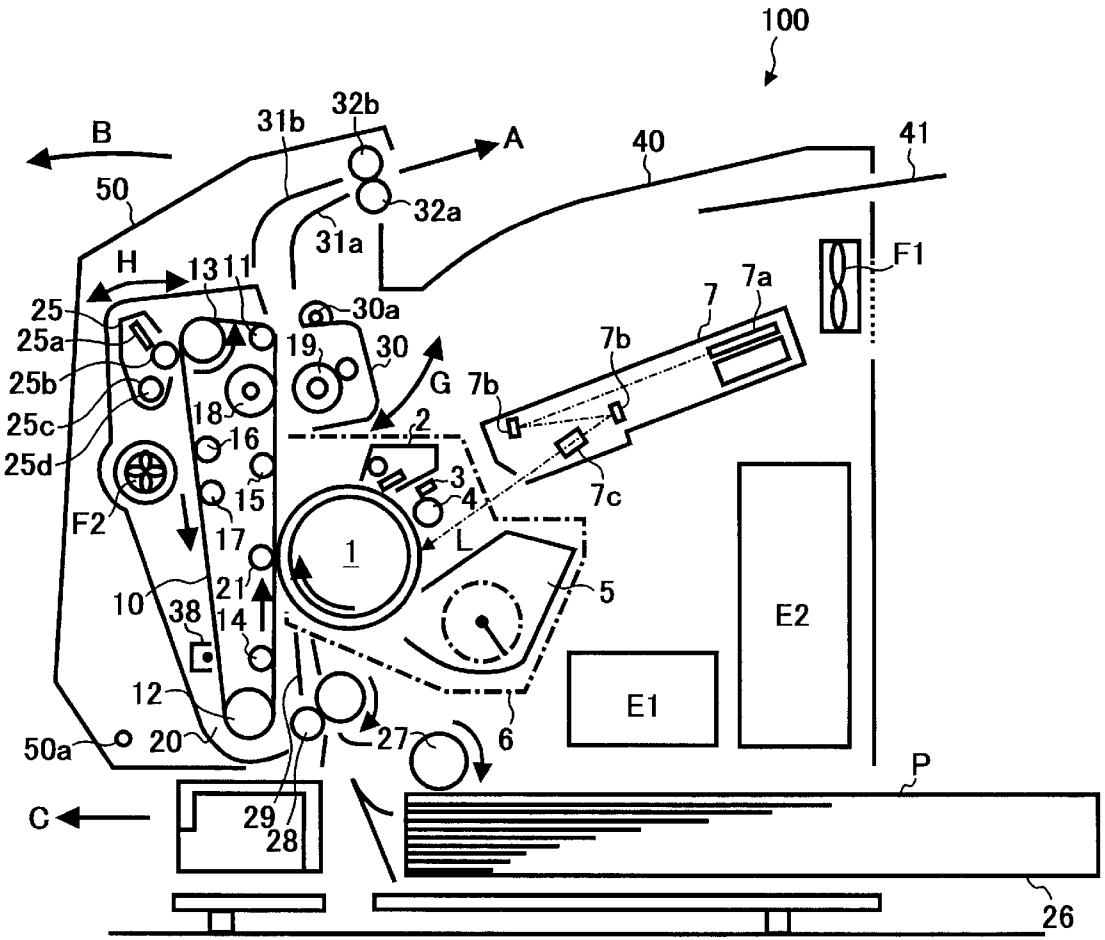
FIG. 15 is a cross section illustrating a printer as an example of an image forming apparatus according to another preferred embodiment of the present invention, in which a belt unit is vertically arranged.

FIG. 15 is a cross section illustrating a printer as an example of an image forming apparatus according to another embodiment of the present invention, in which the belt unit 20 is vertically arranged. In the embodiment, a sheet P is conveyed in an upward direction by the intermediate transfer belt 10 serving as a second image bearing member. The fixing device 30 which is substantially the same as the fixing device of FIG. 3 is used. Except that the belt unit 20 is vertically arranged, the construction and the operation of the printer 100 is substantially the same as that of the printer 100 of FIG. 12, and therefore the further description thereof is omitted.

Figure 16:
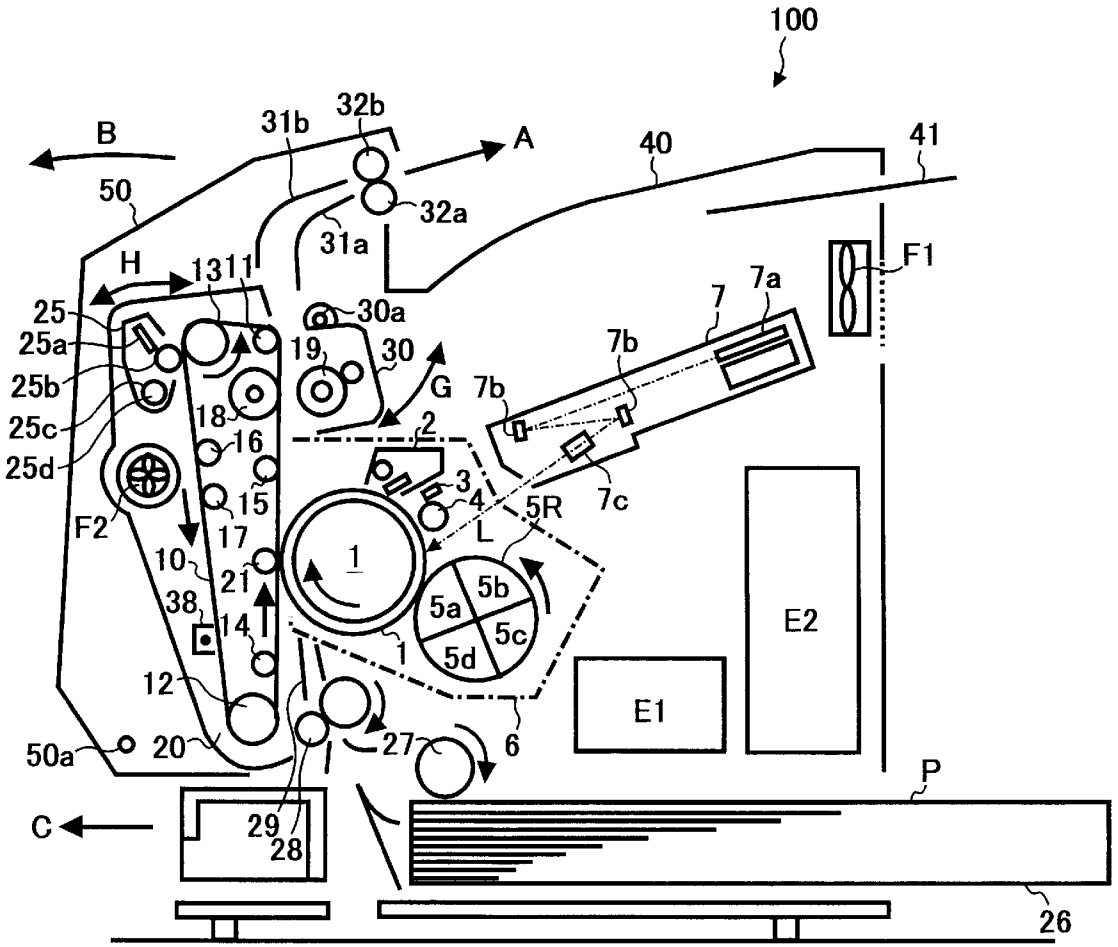
FIG. 16 is a cross section illustrating a color image forming apparatus according to still another preferred embodiment of the present invention, in which a revolver type developing apparatus is used.
Figure 17:
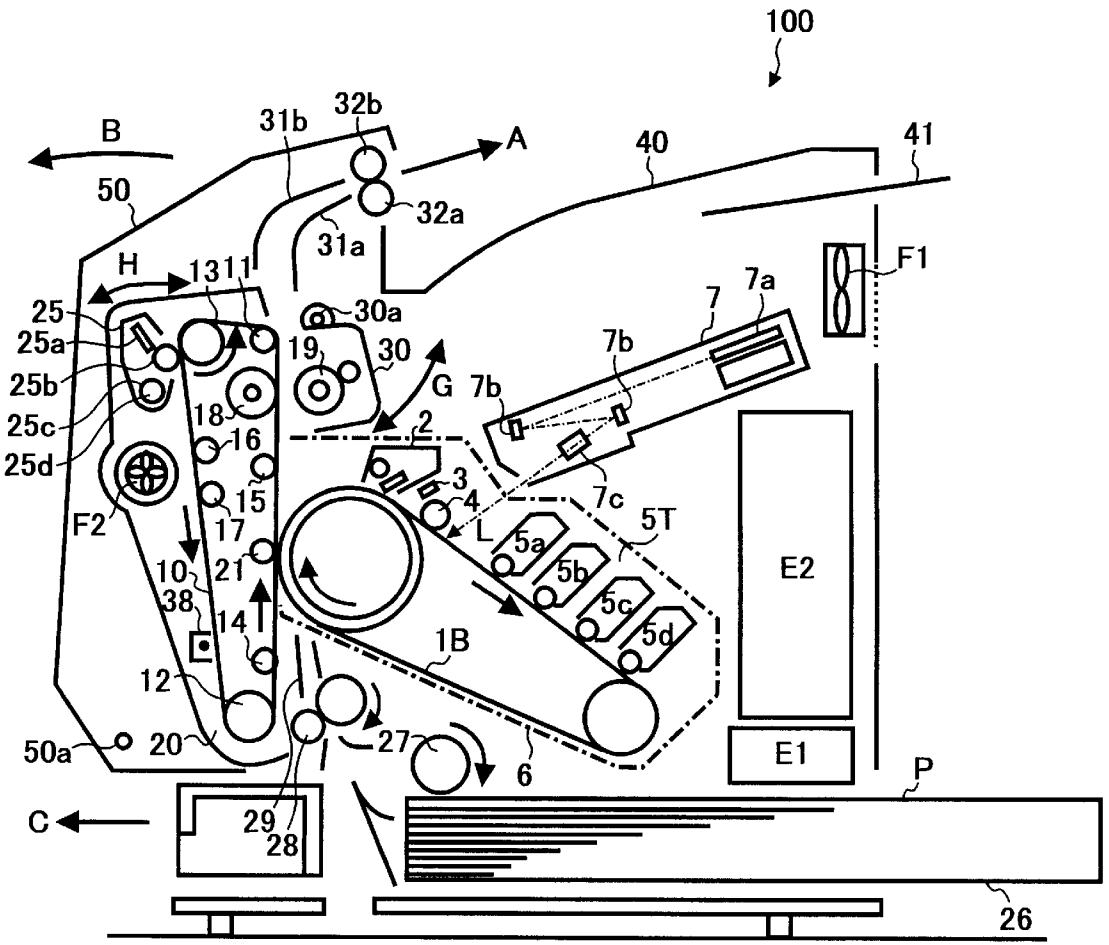
FIG. 17 is a cross section illustrating a color image forming apparatus according to still another preferred embodiment of the present invention, in which a tandem type developing apparatus is arranged at one side of a photoconductor belt.

FIG. 16 and FIG. 17 are cross sections illustrating color image forming apparatuses according to another preferred embodiment of the present invention. The printer 100 of FIG. 16, as an example of the color image forming apparatus, includes a revolver type developing apparatus SR, and the printer 100 of FIG. 17 includes a tandem type developing apparatus 5T arranged at one side of a photoconductor belt 1B. In the embodiments, the intermediate transfer belt 100 is configured so as to contact and separate from the photoconductor drum 1 or the photoconductor belt 1B. The other parts of the printer 100 are substantially the same as in the printer 100 of FIG. 15 and therefore the description thereof will be omitted.

In FIG. 16, the revolver type developing apparatus 5R includes developing devices 5*a*–5*d*, and is driven to rotate in the counterclockwise direction indicated by an arrow, so that each of the developing devices 5*a*–5*d* is switched to move to a developing position to develop a latent image formed on the photoconductor drum 1. The developing devices 5*a*–5*d* respectively contain toner of different colors for realizing fall color development. For example, the developing device 5*a* contains yellow toner, the developing device 5*b* contains magenta toner, the developing device 5*c* contains cyan toner, and the developing device 5*d* contains black toner. When forming an image in black, the developing device 5*d* containing the black toner is moved to the developing position so as to perform the developing operation as in the previous embodiments.

When forming an image in full color, in a state that the photoconductor drum 1 is separated from the intermediate transfer belt 10, optical information to be developed with the yellow toner is written by the exposure device 7 on the surface of the photoconductor drum 1 which has been charged, so that a corresponding latent image is formed thereupon. The yellow toner is then applied to the latent image by the developing device 5*a* for yellow moved to the developing position. In a similar manner, a magenta image is formed on the photoconductor drum 1 so as to be superimposed with the yellow image. Further, a cyan image is formed to be superimposed with the previous images on the photoconductor drum 1. Lastly, a black image is superimposed with the previously formed images, so that a color image of four colors is formed and carried on the surface of the photoconductor drum 1. The photoconductor drum 1 rotates four times in forming a color image of four colors.

After forming the color image of four colors on the surface of the photoconductor drum 1, the intermediate transfer belt 10 is brought into contact with the photoconductor drum 1, and the color image on the photoconductor drum 1 is transferred by an action of the first transfer A device 21 onto a sheet P conveyed by the registration roller 28 in an appropriate timing.

When forming images on both sides of the sheet P, after a first side image is formed on the surface of the photoconductor drum 1, the photoconductor drum 1 and the intermediate transfer belt 10 are brought into contact with each other, and the first side image is transferred onto the intermediate transfer belt 10, that is moving, by an action of the first transfer device 21. The intermediate transfer belt 10 carrying thereupon the first side image is separated from the photoconductor drum 1 at a predetermined position, and is stopped to wait there. Then, a second side image starts to be formed on the photoconductor drum 1. After a color image of the second side image is formed on the photoconductor drum 1, the intermediate transfer belt 10 starts to be conveyed so that the leading edge of the second side image on the photoconductor drum 1 and that of the first side image on the intermediate transfer belt 10 correctly meet with each other, and the intermediate transfer belt 10 is brought into contact with the photoconductor drum 1. As the second side toner image on the intermediate transfer belt 10 is conveyed to a position where the intermediate transfer belt 10 and the photoconductor drum 1 contact each other after turning one round, the polarity of the second side toner image carried on the intermediate transfer belt 10 is reversed by the action of the charging device 38 arranged in front of the roller 12 in the moving direction of the intermediate transfer belt 10.

The sheet P is conveyed by the registration roller 28 in the appropriate timing so as to correctly meet with the first side image on the intermediate transfer belt 10 and the second side image on the photoconductor drum 1. The sheet P is conveyed to the transfer position where the photoconductor drum 1 and the intermediate transfer belt 10 contact each other, and the first side and second side toner images are transferred by the transfer device 21 onto both sides of the sheet P at one time. The sheet P carrying color images on both sides thereof is then conveyed to the fixing area of the fixing device 30 in the state that the sheet P and the intermediate transfer belt 10 are overlapped with each other. The fixing operation and subsequent operations are substantially the same as in the previous embodiments and therefore the description thereof is omitted.

In FIG. 17, the photoconductor belt 1B is rotatably spanned around rollers 51 and 52, and the tandem type developing apparatus device 5T including four developing devices 5*a*–5*d* is arranged along an upper side of the photoconductor belt 1B. The developing devices 5*a*–5*d* are configured to individually move to developing positions near the photoconductor belt 1B and positions separated from the photoconductor belt 1B. The developing devices 5*a*–5*d* respectively contain toner of different colors for realizing fall color development. For example, the developing device 5*a* contains yellow toner, the developing device 5*b* contains magenta toner, the developing device 5*c* contains cyan toner, and the developing device 5*d* contains black toner. When forming an image in black, the developing device 5*d* containing the black toner is moved to the developing position so as to perform the developing operation as in the previous embodiments.

The operation of the printer 100 of FIG. 17 when forming a fall color image is substantially the same as in the printer 100 of FIG. 16. While the intermediate transfer belt 1B is being rotated four times, each of the developing devices 5*a*–5*d* is brought into contact with the photoconductor belt 1B, so that images of respective colors are superimposed with each other on the intermediate transfer belt 1B to be formed into a full color image. The other aspects of the printer 100 of FIG. 17 are substantially the same as in the printer 100 of FIG. 16, and therefore the description thereof is omitted.

Figure 18:
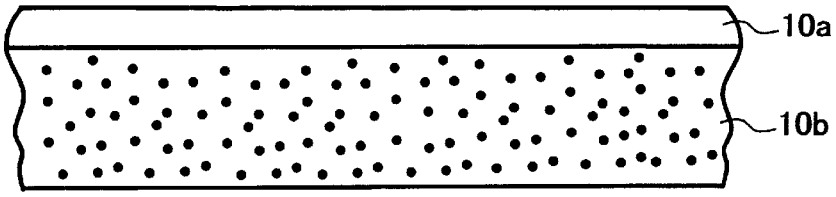
FIG. 18 is a cross section of an intermediate transfer belt as an example of a heat-resisting transfer belt according to an embodiment of the present invention.

Now, the intermediate transfer belt 10 as the second image bearing member is described. In the above embodiments, the intermediate transfer belt 10 is required to stand heat so as not to be extended or deformed in the fixing operation. Further, the intermediate transfer belt 10 must have a characteristics of a transfer belt. FIG. 18 is a cross section of the intermediate transfer belt 10 as an example of a heat-resisting transfer belt according to an embodiment of the present invention. As illustrated in FIG. 18, the intermediate transfer belt 10 has a layer construction in which a surface layer 10*a* is formed on a substrate member 10*b*.

Because the intermediate transfer belt 10 must have an electric characteristics of a transfer belt, the two-layer construction is preferable. Further, in order to secure stability in transferring an image onto the intermediate transfer belt 10 or in transferring the image onto a sheet P from the intermediate transfer belt 10, the volume resistivity of the intermediate transfer belt 10 must be within the range of $10^6$–$10^{12}\Omega\cdot$cm. Because the transfer ratio of a toner image decreases as the volume resistivity of the intermediate transfer belt 10 increases, considering tolerance of the transfer ratio, the volume resistivity of the intermediate transfer belt 10 is preferable to be within the range of $10^6$–$10^9\Omega\cdot$cm.

Further, when stable conveyance of the sheet P is considered, because the surface of the intermediate transfer belt 10 must always electrostatically hold the sheet P irrespective of the environmental condition, the electric resistance of the surface layer 10*a* must be maintained in the range of $10^8$–$10^{12}\Omega/\text{cm}^2$.

Furthermore, with respect to the substrate member lob, considering a relation between a surface resistivity of the surface layer 10*a* and the volume resistivity of the intermediate transfer belt 10, and reduction of contact resistance of an electrode that applies a transfer current (when the transfer device is a contact type device such as a transfer roller), the surface resistivity of the substrate member 10*b* is preferably in the range of $10^5$–$10^9\Omega/\text{cm}^2$.

In the printer 100 according to the above embodiments, because the fixing operation is performed while the intermediate transfer belt 10 is holding a recording medium thereupon, the intermediate transfer belt 10 constantly receives a repeated stress cycle of heating and cooling. As material for the substrate member 10*b* of the intermediate transfer belt 10 that can stand such repeated stress cycle of heating and cooling, a heat resisting resin film of a polyimide family (including polyamide) is preferable. Further, a treatment for decreasing the resistivity must be applied to such material. Furthermore, considering that a toner image is fixed onto a recording medium while the recording medium is held on the surface of the intermediate transfer belt 10 and that toner may therefore adhere to the surface of the intermediate transfer belt 10, as material for the surface layer 10*a*, material of a Teflon family, for example, PFA (perfluoroalkoxy), or PTFE (polytetrafluoroethylene), is preferable in order to obtain good releasing of the adhered toner from the intermediate transfer belt 10. In using the Teflon family material, the resistivity thereof must be controlled in order to obtain stable transferring of an image and conveyance of a recording medium.

Generally, transfer belts are not designed on the assumption that the belts are heated, and therefore the heat-resisting property is about 100° C. However, in the printer 100 of the above embodiments, because the fixing operation is performed while a recording medium is held on the intermediate transfer belt 10, the intermediate transfer belt 10 must stand the heat in the fixing operation. That is, the intermediate transfer belt 10 should not be deformed by the fixing heat of 150–300° C., which is generally generated in the fixing operation of the printer 100. Specifically, the intermediate transfer belt 10 should not extend, wave, melt or dissolve. Therefore, in the embodiment, material of a polyimide family is used for the intermediate transfer belt 10 so as to stand the heat of 150–300° C. It is needless to say that the intermediate transfer belt 10 should not deform, melt or dissolve in the temperature range of up to 150° C. in which image forming apparatuses such as the printer 100 is generally used.

As described above, the intermediate transfer belt 10 receives constant stress of heating and cooling. Therefore, consideration must be also given to a resistivity control agent for the intermediate transfer belt 10. For example, an agent, which is affected by water moisture in air, e.g., an ion conduction type agent, is always changed in the resistivity by receiving the above repeated stress of heating and cooling, so that when such a resistivity control agent is used for the intermediate transfer belt 10, control of an applying current (voltage) in a transfer operation is relatively difficult. Accordingly, in the embodiment, as material of the resistivity control agent for each of the surface layer 10*a* and the substrate member 10*b*, electron conduction type carbon or metal oxide, which hardly changes in the resistivity by increase or decrease of the water moisture and which stands heat stress, is used.

Figure 19:
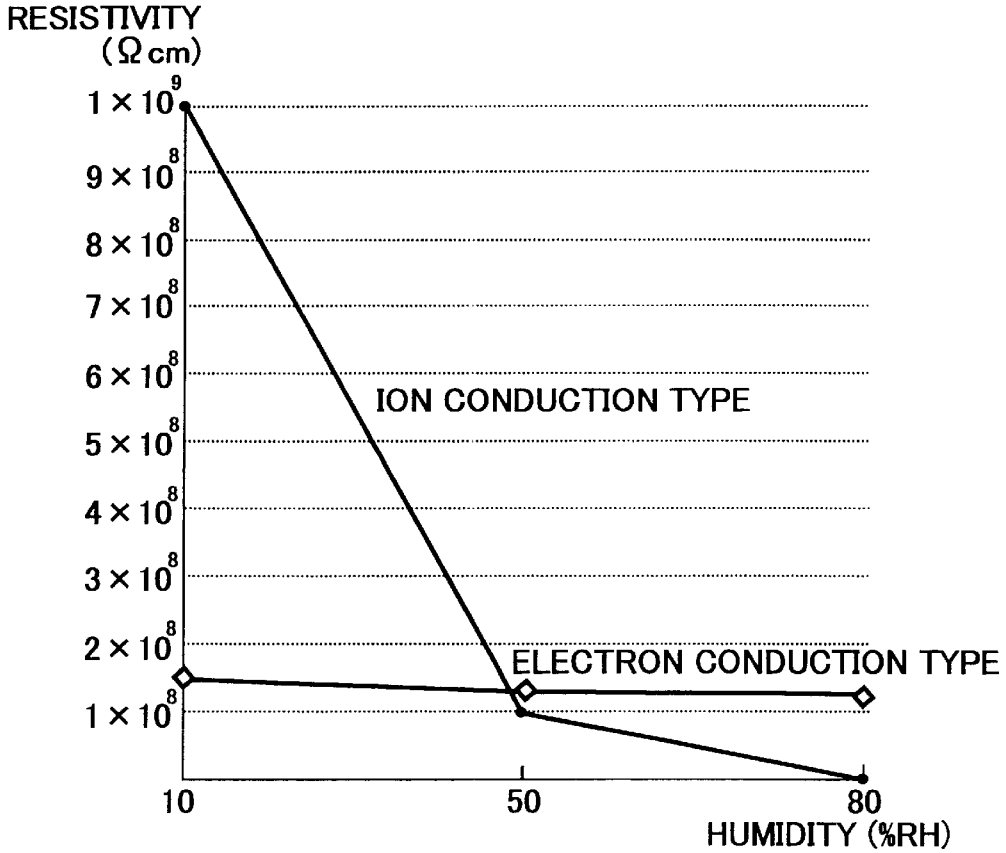
FIG. 19 is a graph indicating a change in the resistivity (Ωcm) of ion conduction type and electron conduction type resistivity control agents according to a change in the humidity (% RH).

FIG. 19 is a graph indicating changes in the resistivity ($\Omega$cm) of ion conduction type and electron conduction type resistivity control agents according to a change in the humidity (% RH). From the graph, it can be understood that the electron conduction type resistivity control agent hardly changes in the resistivity according to a humidity change.

With respect to the thickness of the intermediate transfer belt 10, because an image is fixed onto a recording medium while the recording medium is overlapped with the intermediate transfer belt 10, as the intermediate transfer belt 10 is thinner, the heat conduction efficiency of the intermediate transfer belt is higher and thereby fixing efficiency is higher. Further, heating and cooling response must be fast. Therefore, when the heat conduction efficiency is considered, the thickness of the intermediate transfer belt 10 is preferably equal to or smaller than 200 $\mu$m. However, when strength required for the intermediate transfer belt 10 is considered, such as strength against mechanical stress due to tension or correction of shifting to one side, the thickness of the intermediate transfer belt 10 must be equal to or greater than 50 $\mu$m. Further, the thickness of the surface layer 10*a* is preferably equal to or smaller than 20 $\mu$m considering heat conduction efficiency, toner releasing property and mechanical strength against abrasion, and the surface roughness (Rz) of the surface layer 10*a* is preferably equal to or smaller than 10 so that melted toner will not adhere to concave or convex portions of the surface layer 10*a*. Background transfer belts are generally about 500 $\mu$m in thickness.

Next, description is made with respect to experiments performed by the inventors for confirming the effect of a heat-resisting transfer belt of the present invention. The experiments have been performed using the printer 100 of FIG. 3 using three examples of a heat-resisting transfer belt for the intermediate transfer belt 10, one example according to the above embodiment of the present invention and two comparative examples 1 and 2, described below.

The intermediate transfer belt 10 according to the above embodiment of the present invention has belt thickness of 160 $\mu$m (substrate member: 150 $\mu$m, surface layer: 10 $\mu$m), and volume resistivity of $10^9\Omega\cdot$cm (surface resistivity of the substrate member: $10^7\Omega/cm^2$, surface resistivity of the surface layer: $10^{11}\Omega/cm^2$). Material of the substrate member 10*b* is a heat-resisting resin film of a polyimide family, and material of the surface layer 10*a* is low resistance PFA in which carbon is mixed as a resistivity control agent.

A test has been performed using the printer 100 of FIG. 3 incorporating the above-described intermediate transfer belt 10, so as to transfer toner images onto both sides of a transfer sheet as a recording medium and to fix the toner images on both sides of the transfer sheet at the same time. In the test, transfer of a first toner image from the photoconductor drum 1 as a first image bearing member to the intermediate transfer belt 10, transfer of the first toner image to the transfer sheet and transfer of a second toner image from the photoconductor drum I to the transfer sheet were stably performed. Further, when the transfer sheet is conveyed by the intermediate transfer belt 10, the transfer sheet was kept in close contact with the intermediate transfer belt 10, and further, fixing were satisfactorily performed equally for both sides of the transfer sheet. Thus, a satisfactory result was obtained with respect to transfer, conveyance and fixing operations.

In the comparative example 1 of the intermediate transfer belt 10, the thickness was changed to 45 $\mu$m (substrate member: 40 $\mu$m, surface layer: 5 $\mu$m). When the same test as described above was performed with the printer 100 of FIG. 3, even though sufficient tension has been given to the intermediate transfer belt 10, the intermediate transfer belt 10 was waved. Thereby, even though transfer of an image to the intermediate transfer belt 10 has been satisfactorily performed, a transfer sheet was sufficiently in close contact with the intermediate transfer belt 10, and thereby the transfer sheet was moved on the intermediate transfer belt 10 while being conveyed to the fixing area, so that the image on the transfer sheet was disturbed. In addition, the transfer sheet was shrunk in the fixing process.

In the comparative example 2 of the intermediate transfer belt 10, the resistivity control agent was changed to an ion conduction type agent. When a test to transfer and fix an image onto one side of a transfer sheet was performed, transfer and fixing of the image was satisfactorily performed for the first sheet. However, when the transfer and fixing of the image onto one side of a transfer sheet was successively performed for the second sheet, the resistivity of a part of the intermediate transfer belt 10 passed the fixing area was greatly increased to exceed the capacity of the high voltage power source, disabling subsequent transferring operations. After a few hours, the resistivity of the intermediate transfer belt 10 recovered. However, when another test was performed, the resistivity of the intermediate transfer belt 10 increased again.

In addition, a similar test was performed using the intermediate transfer belt 10, the material of which was changed. When the material of the surface layer 10*a* is changed to material other than one of a Teflon family, toner adheres to the intermediate transfer belt 10, causing an offset image. When the material of the substrate member 10*b* is changed to material other than one of a polyimide family, the intermediate transfer belt 10 itself was deformed or extended due to heat for the fixing operation.

Thus, when a heat-resisting transfer belt of the present invention is used for an intermediate transfer belt, serving as a second image bearing member, in an image forming apparatus of the above embodiments, in which the fixing operation is performed while a recording medium is held on the intermediate transfer belt, good transfer, conveyance and fixing performance have been realized, and thereby stable image quality has been obtained.

Figure 20:
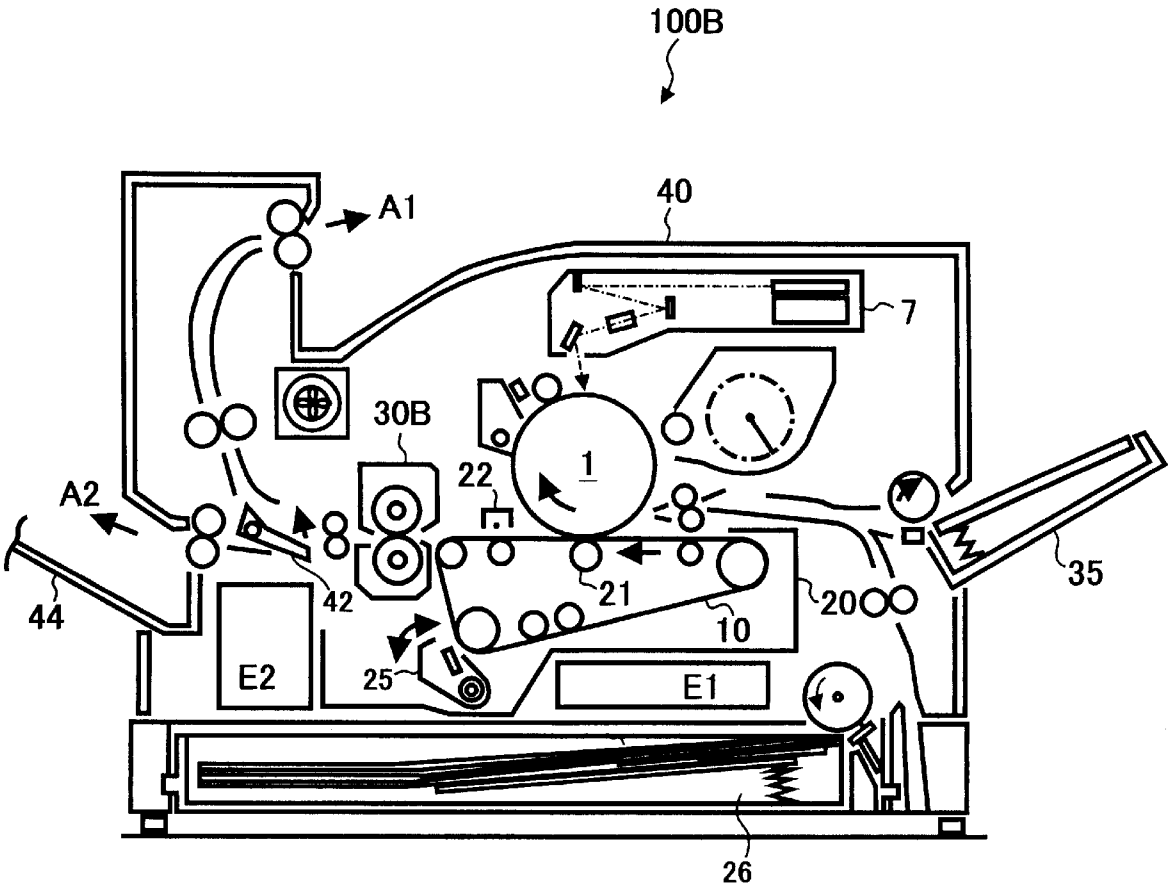

FIG. 20 is a cross section illustrating an image forming apparatus in which a recording medium is conveyed to a fixing device after having been separated from an intermediate transfer belt.

As illustrated in FIG. 20, in the printer 100B, the fixing device 30B is arranged outside of the intermediate transfer belt 10. That is, a recording medium carrying a transferred image on one or both sides thereof is conveyed into a fixing nip of the fixing device 30B after separating from the intermediate transfer belt 10.

In the belt unit 20, the intermediate transfer belt 10 extends in a horizontal direction. Further, the first transfer device 21 arranged in a loop of the intermediate transfer belt 10 is configured to be a contact type transfer roller. In addition to the discharging/stacking part 40 on an upper surface of the main body of the printer 100B, a discharging tray 44 is provided to a side of the main body, and a manual feeding tray 35 serving as a second sheet feeding device is provided to the opposite side of the main body.

In the printer 100B, a recording medium onto which a toner image has been transferred on one side or both sides thereof is conveyed to the fixing nip part of the fixing device 30B after having been separated from the intermediate transfer belt 10, so that the toner image is fixed onto the recording medium. The conveying direction of the recording medium after passing through the fixing device 30B is switched by a switching claw 42 to the discharging/stacking part 40 or to the discharging tray 44.

In the printer 100B, the intermediate transfer belt 10 according to the above embodiment of the present invention is used. Namely, the intermediate transfer belt 10 has belt thickness of 160 $\mu$m (substrate member: 150 $\mu$m, surface layer: 10 $\mu$m), and volume resistivity of $10^9\Omega\cdot$cm (surface resistivity of the substrate member: $10^7\Omega/cm^2$, surface resistivity of the surface layer: $10^{11}\Omega/cm^2$). Material of the substrate member 10*b* is a heat-resisting resin film of polyimide, and material of the surface layer 10*a* is low resistance PFA in which carbon is mixed as a resistivity control agent.

In a similar test performed with the printer 10B, transfer of a first toner image to the intermediate transfer belt 10 from the photoconductor drum 1, transfer of the first toner image to a transfer sheet as a recording medium and transfer of a second toner image from the photoconductor drum 1 to the transfer sheet have been all stably performed. Further, the transfer sheet has closely contacted the intermediate transfer belt 10 while being conveyed by the intermediate transfer belt 10. Thus, a satisfactory result has been obtained with respect to transfer and conveyance operations. With respect to the fixing operation, because the fixing operation is performed after the transfer sheet has been separated from the intermediate transfer belt 10, also a satisfactory result has been obtained.

The present invention has been described with respect to the embodiments illustrated in figure. However, the present invention is not limited to the embodiments and may be practiced otherwise.

For example, with provision of a mechanism to switch the polarity of toner as in the apparatus disclosed in JP Publication No. 3-253882, toner images can be transferred onto both sides of a sheet by a single transfer device instead of providing two transfer devices.

Further, when recording images on both sides of a sheet, instead of turning one round the intermediate transfer belt 10 carrying thereupon a first side image, the intermediate transfer belt 10 can be rotated in the reverse direction to convey the first side image to a predetermined position. In this case, a mechanism is required to allow a first image bearing member (e.g., the photoconductor drum 1) to separate from a second image bearing member (e.g., the intermediate transfer belt 10) even in an image forming apparatus configured to 10 At form an image only on one side of a sheet.

Furthermore, in the above embodiments, the first image bearing member is configured to be a photoconductor drum. However, the first image bearing member can be configured to be a belt. The charging polarity of the photoconductor drum 1 and the toner, and the polarity of the transfer voltage are examples and can be reversed, respectively.

Further, in the above embodiments, the exposure device 7 uses a laser system. However, an LED system may be also used.

Furthermore, the present invention can be practiced in an analogue type image forming apparatus using an analogue type exposure device. When the analogue type exposure device is used, a correct image can be obtained on a photoconductor by arranging a mirror.

Still furthermore, a charging device for a first image bearing member, a developing device, first and second transfer devices, and a fixing device can be constructed otherwise than as described in the above embodiments, and various other systems can be used.

The temperature of the fixing devices 18 and 30 (30B) and/or the method of controlling the temperature are just examples and can be appropriately set.

The present invention has been described with respect to the printer 100 as an example of an image forming apparatus. However, it is needless to say that the present invention can be applied to other image forming apparatuses such as a copier or a facsimile machine.

Further, when the image forming apparatus according to the above embodiments are color image forming apparatuses, the order of forming images of respective colors and/or the arrangement of the developing devices for respective colors are not limited to the ones described above and can be practiced otherwise.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Applications No. 2000-173701, No. 2000-173702, No. 2000-242917, No. 2001-143379, No. 2001-147928, and No. 2001-152437, filed in the Japanese Patent Office on Jun. 9, 2000, Jun. 9, 2000, Aug. 10, 2000, May 14, 2001, May 17,2001, and May 22, 2001, respectively, and the entire contents of which are hereby incorporated by reference.

What is claimed as new and is desired to be secured by Letter Patent of the United States is:

1. An image forming apparatus, comprising:

a first image bearing member;

a second image bearing member; and a fixing device opposing the second image bearing member, wherein a first visual image formed on the first image bearing member is transferred onto the second image bearing member for transferring from the second image bearing member onto a first side of a recording medium, wherein a second visual image formed on the first bearing member is transferred from the first image bearing member onto a second side of the recording medium, so that the visual images are obtained on the first and second sides of the recording medium respectively, and wherein the visual images on the first and second sides of the recording medium are fixed by the fixing device in a state that the recording medium is interposed between the second image bearing member and the fixing device.

2. An image forming apparatus, comprising:

a first image bearing member;

a second image bearing member;

a fixing device opposing the second image bearing member;

a first transfer device configured to transfer a first visual image carried by the first image bearing member onto the second image bearing member or to transfer a second visual image carried by the first image bearing member onto a recording medium; and a second transfer device configured to transfer the first visual image carried by the second image bearing member onto the recording medium, wherein the first visual image is transferred from the second image bearing member onto a first side of the recording medium and the second visual image is transferred from the first image bearing member onto a second side of the recording medium, so that the visual images are obtained on the first and second sides of the recording medium respectively, and wherein the visual images on the first and second sides of the recording medium are fixed by the fixing device in a state that the recording medium is interposed between the second image bearing member and the fixing device.

3. An image forming apparatus of electrophotography, comprising:

a first image bearing member having a photoconductive property;

a developing device configured to visualize an image on the first image bearing member into a toner image;

a second image bearing member configured to carry thereupon the toner image transferred from the first image bearing member; and a fixing device opposing the second image bearing member, wherein a first toner image formed on the first image bearing member is transferred onto the second image bearing member for transferring from the second image bearing member onto a first side of a recording medium, wherein a second toner image formed on the first image bearing member is transferred onto a second side of the recording medium, so that the toner images are obtained on the first and second sides of the recording medium respectively, and wherein the toner images on the first and second sides of the recording medium are fixed by the fixing device in a state that the recording medium is interposed between the second image bearing member and the fixing device.

4. The image forming apparatus of claim 1, wherein when obtaining one of the visual images on the first and second sides of the recording medium, the first visual image on the first image bearing member is directly transferred onto the second side of the recording medium.

5. The image forming apparatus of claim 2, wherein when obtaining one of the visual images on the first and second sides of the recording medium, the first visual image on the first image bearing member is directly transferred onto the second side of the recording medium.

6. The image forming apparatus of claim 3, wherein when obtaining one of the toner images on the first and second sides of the recording medium, the toner image on the first image bearing member is directly transferred onto the second side of the recording medium.

7. The image forming apparatus of claim 1, wherein whether to obtain one of or both of the visual images on the first and second sides of the recording medium is set as a default condition.

8. The image forming apparatus of claim 2, wherein whether to obtain one of or both of the visual images on the first and second sides of the recording medium is set as a default condition.

9. The image forming apparatus of claim 3, wherein whether to obtain one of or both of the toner images on the first and second sides of the recording medium is set as a default condition.

10. The image forming apparatus of claim 1, further comprising a cooling device configured to cool the second image bearing member.

11. The image forming apparatus of claim 10, the cooling device including an air circulating device, and wherein when the first visual image is transferred from the first image bearing member onto the second image bearing member, the air circulating device is not operated before the first visual image transferred onto the second image bearing member is transferred onto the first side of the recording medium.

12. The image forming apparatus of claim 10, further comprising a cleaning device configured to clean the second image bearing member and arranged upstream of the cooling device in a moving direction of the second image bearing member.

13. The image forming apparatus of claim 2, further comprising a cooling device configured to cool the second image bearing member.

14. The image forming apparatus of claim 13, the cooling device including an air circulating device, and wherein when the first visual image is transferred from the first image bearing member onto the second image bearing member, the air circulating device is not operated before the first visual image transferred onto the second image bearing member is transferred onto the first side of the recording medium.

15. The image forming apparatus of claim 13, further comprising a cleaning device configured to clean the second image bearing member and arranged upstream of the cooling device in a moving direction of the second image bearing member.

16. The image forming apparatus of claim 3, further comprising a cooling device configured to cool the second image bearing member.

17. The image forming apparatus of claim 16, the cooling device including an air circulating device, and wherein when the first toner image is transferred from the first image bearing member onto the second image bearing member, the air circulating device is not operated before the first toner image transferred onto the second image bearing member is transferred onto the first side of the recording medium.

18. The image forming apparatus of claim 16, further comprising a cleaning device configured to clean the second image bearing member and arranged upstream of the cooling device in a moving direction of the second image bearing member.

19. The image forming apparatus of claim 1, further comprising a charging device, and wherein after the first visual image formed on the first image bearing member is transferred from the first image bearing member onto the second image bearing member, a charging polarity of the first visual image is reversed on the second image bearing member by the charging device, so that the first and the second visual images are transferred onto the first and second sides of the recording medium substantially at a same time.

20. The image forming apparatus of claim 19, the charging device comprising a non-contact type charging device.

21. The image forming apparatus of claim 19, wherein the second visual image is formed on the first image bearing member such that the first and second visual images are substantially aligned on the recording medium.

22. The image forming apparatus of claim 21, wherein the first and the second visual images are transferred onto the first and second sides of the recording medium at substantially the same time under a transfer condition to transfer the second visual image onto the recording medium.

23. The image forming apparatus of claim 19, further comprising a transfer device arranged so as to apply a transfer electric field from an opposite side of a side of the second image bearing member, carrying thereupon the first visual image.

24. The image forming apparatus of claim 23, wherein the transfer device transfers the first visual image from the first image bearing member onto the second image bearing member.

25. The image forming apparatus of claim 19, wherein when only one of the first and the second visual images is formed, the first visual image formed on the first image bearing member is directly transferred onto the recording medium, and the recording medium is conveyed by the second image bearing member to a fixing area of the fixing device.

26. The image forming apparatus of claim 19, wherein the first image bearing member comprises a photoconductive member, the first image bearing member is negatively charged, and a latent image obtained by exposing the first image bearing member is developed by a developer having a negative charge.

27. The image forming apparatus of claim 2, further comprising a charging device, and wherein after the first visual image formed on the first image bearing member is transferred from the first image bearing member onto the second image bearing member, a charging polarity of the first visual image is reversed on the second image bearing member by the charging device, so that the first and the second visual images are transferred onto the first and second sides of the recording medium substantially at a same time.

28. The image forming apparatus of claim 27, the charging device comprising a non-contact type charging device.

29. The image forming apparatus of claim 27, wherein the second visual image is formed on the first image bearing member such that the first and second visual images are substantially aligned on the recording medium.

30. The image forming apparatus of claim 29, wherein the first and the second visual images are transferred onto the first and second sides of the recording medium at substantially the same time under a transfer condition to transfer the second visual image onto the recording medium.

31. The image forming apparatus of claim 27, wherein when only one of the first and the second visual images is formed, the first visual image formed on the first image bearing member is directly transferred onto the recording medium, and the recording medium is conveyed by the second image bearing member to a fixing area of the fixing device.

32. The image forming apparatus of claim 27, wherein the first image bearing member comprises a photoconductive member, the first image bearing member is negatively charged, and a latent image obtained by exposing the first image bearing member is developed by a developer having a negative charge.

33. The image forming apparatus of claim 3, further comprising a charging device, and wherein after the first toner image formed on the first image bearing member is transferred from the first image bearing member onto the second image bearing member, a charging polarity of the first toner image is reversed on the second image bearing member by the charging device, so that the first and the second toner images are transferred onto the first and second sides of the recording medium substantially at a same time.

34. The image forming apparatus of claim 33, the charging device comprising a non-contact type charging device.

35. The image forming apparatus of claim 33, wherein the second toner image is formed on the first image bearing member such that the first and second toner images are substantially aligned on the recording medium.

36. The image forming apparatus of claim 35, wherein the first and the second toner images are transferred onto the first and second sides of the recording medium at substantially the same time under a transfer condition to transfer the second toner image onto the recording medium.

37. The image forming apparatus of claim 33, further comprising a transfer device arranged so as to apply a transfer electric field from an opposite side of a side of the second image bearing member, carrying thereupon the first toner image.

38. The image forming apparatus of claim 37, wherein the transfer device transfers the first toner image from the first image bearing member onto the second image bearing member.

39. The image forming apparatus of claim 33, wherein when only one of the first and the second toner images is formed, the first toner image formed on the first image bearing member is directly transferred onto the recording medium, and the recording medium is conveyed by the second image bearing member to a fixing area of the fixing device.

40. The image forming apparatus of claim 33, wherein the first image bearing member comprises a photoconductive member, the first image bearing member is negatively charged, and a latent image obtained by exposing the first image bearing member is developed by a developer having a negative charge.

41. The image forming apparatus of claim 1, wherein the second image bearing member is an endless belt.

42. The image forming apparatus of claim 41, wherein the endless belt second image bearing member is configured so that a first visual image transfer area where the first visual image is transferred from the first image bearing member onto the endless belt second image bearing member or the second visual image is transferred from the first image bearing member onto the recording medium and a second visual image transfer area where the second visual image on the endless belt second image bearing member is transferred onto the recording medium are located at a stretched side of the endless belt second image bearing member.

43. The image forming apparatus of claim 41, wherein the recording medium is conveyed by the endless belt second image bearing member in a vertical direction.

44. The image forming apparatus of claim 43, wherein the fixing device is arranged above the first image bearing member in a direction of gravity.

45. The image forming apparatus of claim 41, further comprising a cleaning device configured to clean the endless belt second image bearing member, and wherein the cleaning device cleans the endless belt second image bearing member when the fixing device is being operated.

46. The image forming apparatus of claim 41, further comprising:

a main body accommodating at least the first image bearing member;

a unit accommodating at least the endless belt second image bearing member and configured so as to be opened relative to the main body; and a recording medium conveying path, wherein when the unit is opened, the recording medium conveying path is opened.

47. The image forming apparatus of claim 41, the fixing device including a first fixing device arranged inside of a loop of the endless belt second image bearing member to fix the first visual image transferred onto the first side of the recording medium and a second fixing device arranged outside of the loop of the endless belt second image bearing member to fix the second image transferred onto the second side of the recording medium.

48. The image forming apparatus of claim 47, wherein a temperature of at least one of the first and second fixing devices is changed when obtaining one of the visual images on the first and second sides of the recording medium from when obtaining both of the visual images.

49. The image forming apparatus of claim 47, further comprising a controller to control an operation of the apparatus, and wherein each of the temperatures of the first and the second fixing devices is individually controlled by the controller.

50. The image forming apparatus of claim 47, wherein when the first visual image is transferred from the first image bearing member onto the endless belt second image bearing member, until the first visual image on the endless belt second image bearing member is transferred onto the recording medium, at least one of the first and the second fixing devices is stopped from being heated or is decreased in the temperature.

51. The image forming apparatus of claim 47, wherein the second fixing device is configured to contact and to separate from the endless belt second image bearing member, and wherein when the first visual image is transferred from the first image bearing member onto the endless belt second image bearing member, until the first visual image transferred onto the endless belt second image bearing member is transferred onto the recording medium, the second fixing device is kept separated from the endless belt second image bearing member.

52. The image forming apparatus of claim 47, wherein the second fixing device is a non-contact type fixing device.

53. The image forming apparatus of claim 41, further comprising a temperature detect device configured to detect a temperature of the endless belt second image bearing member.

54. The image forming apparatus of claim 41, the endless belt second image bearing member including a recording medium separation part where the recording medium separates therefrom, and wherein the endless belt second image bearing member turns less than 90° at the recording medium separation part.

55. The image forming apparatus of claim 41, the endless belt second image bearing member including a recording medium separation part where the recording medium separates from the endless belt, and wherein the fixing device is arranged upstream of the recording medium separation part of the endless belt second image bearing member in a recording medium conveying direction and near the recording medium separation part.

56. The image forming apparatus of claim 2, wherein the second image bearing member is an endless belt.

57. The image forming apparatus of claim 56, wherein the endless belt second image bearing member is configured so that a first visual image transfer area where the first visual image is transferred from the first image bearing member onto the endless belt second image bearing member or the second visual image is transferred from the first image bearing member onto the recording medium and a second visual image transfer area where the second visual image on the endless belt second image bearing member is transferred onto the recording medium are located at a stretched side of the endless belt second image bearing member.

58. The image forming apparatus of claim 56, wherein the recording medium is conveyed by the endless belt second image bearing member in a vertical direction.

59. The image forming apparatus of claim 58, wherein the fixing device is arranged above the first image bearing member in a direction of gravity.

60. The image forming apparatus of claim 56, further comprising a cleaning device configured to clean the endless belt second image bearing member, and wherein the cleaning device cleans the endless belt second image bearing member when the fixing device is being operated.

61. The image forming apparatus of claim 56, further comprising:

a main body accommodating at least the first image bearing member;

a unit accommodating at least the endless like image bearing member and configured so as to be opened relative to the main body; and a recording medium conveying path, wherein when the unit is opened, the recording medium conveying path is opened.

62. The image forming apparatus of claim 56, the fixing device including a first fixing device arranged inside of a loop of the endless belt second image bearing member to fix the first visual image transferred onto the first side of the recording medium and a second fixing device arranged outside of the loop of the endless belt second image bearing member to fix the second visual image transferred onto the second side of the recording medium.

63. The image forming apparatus of claim 62, wherein a temperature of at least one of the first and second fixing devices is changed when obtaining one of the visual images on the first and second sides of the recording medium from when obtaining both of the visual images.

64. The image forming apparatus of claim 62, further comprising a controller to control an operation of the apparatus, and wherein each of the temperatures of the first and the second fixing devices is individually controlled by the controller.

65. The image forming apparatus of claim 62, wherein when the first visual image is transferred from the first image bearing member onto the endless belt second image bearing member, until the first visual image on the endless belt second image bearing member is transferred onto the recording medium, at least one of the first and the second fixing devices is stopped from being heated or is decreased in the temperature.

66. The image forming apparatus of claim 62, wherein the second fixing device is configured to contact and to separate from the endless belt second image bearing member, and wherein when the first visual image is transferred from the first image bearing member onto the endless belt second image bearing member, until the first visual image transferred onto the endless belt second image bearing member is transferred onto the recording medium, the second fixing device is kept separated from the endless belt second image bearing member.

67. The image forming apparatus of claim 62, wherein the second fixing device is a non-contact type fixing device.

68. The image forming apparatus of claim 56, further comprising a temperature detect device configured to detect a temperature of the endless belt second image bearing member.

69. The image forming apparatus of claim 56, the endless belt second image bearing member including a recording medium separation part where the recording medium separates from the endless belt, wherein the endless belt second image bearing member turns less than 90° at the recording medium separation part.

70. The image forming apparatus of claim 56, the endless belt second image bearing member including a recording medium separation part where the recording medium separates therefrom, wherein the fixing device is arranged upstream of the recording medium separation part of the endless belt second image bearing member in a recording medium conveying direction and near the recording medium separation part.

71. The image forming apparatus of claim 3, wherein the second image bearing member is an endless belt.

72. The image forming apparatus of claim 71, wherein the endless belt second image bearing member is configured so that a first visual image transfer area where the first visual image is transferred from the first image bearing member onto the endless belt second image bearing member or the second visual image is transferred from the first image bearing member onto the recording medium and a second visual image transfer area where the second visual image on the endless belt second image bearing member is transferred onto the recording medium are located at a stretched side of the endless belt second image bearing member.

73. The image forming apparatus of claim 71, wherein the recording medium is conveyed by the endless belt second image bearing member in a vertical direction.

74. The image forming apparatus of claim 73, wherein the fixing device is arranged above the first image bearing member in a direction of gravity.

75. The image forming apparatus of claim 71, further comprising a cleaning device configured to clean the endless belt second image bearing member, and wherein the cleaning device cleans the endless belt second image bearing member when the fixing device is being operated.

76. The image forming apparatus of claim 71, further comprising:

a main body accommodating at least the first image bearing member;

a unit accommodating at least the endless belt second image bearing member and configured so as to be opened relative to the main body; and a recording medium conveying path, wherein when the unit is opened, the recording medium conveying path is opened.

77. The image forming apparatus of claim 71, the fixing device including a first fixing device arranged inside of a loop of the endless belt second image bearing member to fix the first toner image transferred onto the first side of the recording medium and a second fixing device arranged outside of the loop of the endless belt second image bearing member to fix the second toner image transferred onto the second side of the recording medium.

78. The image forming apparatus of claim 77, wherein a temperature of at least one of the first and second fixing devices is changed when obtaining one of the toner images on the first and second sides of the recording medium from when obtaining both of the visual images.

79. The image forming apparatus of claim 77, further comprising a controller to control an operation of the apparatus, and wherein each of the temperatures of the first and the second fixing devices is individually controlled by the controller.

80. The image forming apparatus of claim 77, wherein when the first toner image is transferred from the first image bearing member onto the endless belt second image bearing member, until the first toner image on the endless belt second image bearing member is transferred onto the recording medium, at least one of the first and the second fixing devices is stopped from being heated or is decreased in the temperature.

81. The image forming apparatus of claim 77, wherein the second fixing device is configured to contact and to separate from the endless belt second image bearing member, and wherein when the first toner image is transferred from the first image bearing member onto the endless belt second image bearing member, until the fist toner image transferred onto the endless belt second image bearing member is transferred onto the recording medium, the second fixing device is kept separated from the endless belt second image bearing member.

82. The image forming apparatus of claim 77, wherein the second fixing device is a non-contact type fixing device.

83. The image forming apparatus of claim 71, further comprising a temperature detect device configured to detect a temperature of the endless belt second image bearing member.

84. The image forming apparatus of claim 71, the endless belt second image bearing member including a recording medium separation part where the recording medium separates from the endless belt, wherein the endless belt second image bearing member turns less than 90° at the recording medium separation part.

85. The image forming apparatus of claim 71, the endless belt second image bearing member including a recording medium separation part where the recording medium separates from the endless belt, wherein the fixing device is arranged upstream of the recording medium separation part of the endless belt second image bearing member in a recording medium conveying direction and near the recording medium separation part.

86. The image forming apparatus of claim 41, wherein the endless belt second image bearing member has a heat-resisting property against heat of 150–300° C. and a volume resistivity of $10^6$–$10^{12}\Omega\cdot$cm, and is formed in at least two layers including a substrate member and a surface layer.

87. The image forming apparatus of claim 86, wherein the substrate member comprises a heat-resisting resin film of a polyimide family and has a surface resistivity of $10^5$–$10^9\Omega/cm^2$.

88. The image forming apparatus of claim 87, wherein thickness of the substrate member is between 50 $\mu$m and 200 $\mu$m.

89. The image forming apparatus claim 86, wherein the surface layer comprises a coat layer including at least one of perfluoroalkoxy and polytetrafluoroethylene, and has a surface resistivity of $10^8$–$10^{12}\Omega/cm^2$.

90. The image forming apparatus of claim 89, wherein thickness of the surface layer is 20 $\mu$m or smaller and surface roughness (Rz) of the surface layer is 10 or smaller.

91. The image forming apparatus of claim 86, wherein the endless belt second image bearing member comprises electron conduction material including at least one of carbon or metal oxide.

92. The image forming apparatus of claim 56, wherein the endless belt second image bearing member has a heat-resisting property against heat of 150–300° C. and a volume resistivity of $10^6$–$10^{12}\Omega\cdot$cm, and is formed in at least two layers including a substrate member and a surface layer.

93. The image forming apparatus of claim 92, wherein the substrate member comprises a heat-resisting resin film of a polyimide family and has a surface resistivity of $10^5$–$10^9\Omega/cm^2$.

94. The image forming apparatus of claim 93, wherein thickness of the substrate member is between 50 $\mu$m and 200 $\mu$m.

95. The image forming apparatus claim 92, wherein the surface layer comprises a coat layer including at least one of perfluoroalkoxy and polytetrafluoroethylene, and has a surface resistivity of $10^8$–$10^{12}\Omega/cm^2$.

96. The image forming apparatus of claim 95, wherein thickness of the surface layer is 20 $\mu$m or smaller and surface roughness (Rz) of the surface layer is 10 or smaller.

97. The image forming apparatus of claim 92, wherein the endless belt second image bearing member comprises electron conduction material including at least one of carbon or metal oxide.

98. The image forming apparatus of claim 71, wherein the endless belt second image bearing member has a heat-resisting property against heat of 150–300° C. and a volume resistivity of $10^6$–$10^{12}\Omega\cdot$cm, and is formed in two layers including a substrate member and a surface layer.

99. The image forming apparatus of claim 98, wherein the substrate member comprises a heat-resisting resin film of a polyimide family and has a surface resistivity of $10^5$–$10^9\Omega/cm^2$.

100. The image forming apparatus of claim 99, wherein thickness of the substrate member is between 50 $\mu$m and 200 $\mu$m.

101. The image forming apparatus claim 100, wherein the surface layer comprises a coat layer including at least one of perfluoroalkoxy and polytetrafluoroethylene, and has a surface resistivity of $10^8$–$10^{12}\Omega/cm^2$.

102. The image forming apparatus of claim 101, wherein thickness of the surface layer is 20 $\mu$m or smaller and surface roughness (Rz) of the surface layer is 10 or smaller.

103. The image forming apparatus of claim 98, wherein the endless belt second image bearing member comprises electron conduction material including at least one of carbon or metal oxide.

104. An image forming apparatus, comprising:

a first image bearing member;

a second image bearing member;

a charging device; and a fixing device;

wherein a first image formed on the first image bearing member is transferred onto the second image bearing member, a second image is formed on the first image bearing member, the first and second images are transferred onto both sides of a recording medium at a same time, and the recording medium is conveyed to a fixing area of the fixing device by the second image bearing member, and wherein after the first image is transferred from the first image bearing member onto the second image bearing member, a charging polarity of the first image is reversed on the second image bearing member by the charging device so that the first and the second images are transferred onto the both sides of the recording medium at substantially the same time.

105. The image forming apparatus of claim 104, the charging device comprising a non-contact type charging device.

106. The image forming apparatus of claim 104, wherein the second image is formed on the first image bearing member such that the first and second images are substantially aligned on the recording medium.

107. The image forming apparatus of claim 106, wherein the first and the second images are transferred onto the both sides of the recording medium at substantially the same time under a transfer condition to transfer the second image onto the recording medium.

108. The image forming apparatus of claim 104, further comprising a transfer device arranged so as to apply a transfer electric field from an opposite side of a side of the second image bearing member, carrying thereupon the first image.

109. The image forming apparatus of claim 108, wherein the transfer device transfers the first image from the first image bearing member onto the second image bearing member.

110. The image forming apparatus of claim 104, wherein the first and the second images are fixed onto the recording medium while the recording medium is being overlapped with the second image bearing member.

111. The image forming apparatus of claim 104, wherein when only one of the first and the second images is formed, the first image formed on the first image bearing member is directly transferred onto the recording medium, and the recording medium is conveyed by the second image bearing member to a fixing area of the fixing device.

112. The image forming apparatus of claim 111, wherein the first image is fixed onto the recording medium while the recording medium is overlapped with the second image bearing member.

113. The image forming apparatus of claim 104, wherein the first image bearing member comprises a photoconductive member, the first image bearing member is negatively charged, and a latent image obtained by exposing the first image bearing member is developed by a developer having a negative charge.

114. An image forming apparatus, comprising:

a first image bearing member;

a second image bearing member;

wherein a first visual image transferred from the first image bearing member onto the second image bearing member is transferred onto a first side of a recording medium and a second visual image is transferred from the first image bearing member onto a second side of the recording medium, so that the visual images are formed on the first and second sides of the recording medium, and wherein the second image bearing member comprises a heat-resisting transfer belt having a heat-resisting property against heat of 150–300° C. and a volume resistivity of $10^6$–$10^{12}\Omega\cdot$cm, and formed in at least two layers including a substrate member and a surface layer.

115. The image forming apparatus of claim 114, wherein the substrate member comprises a heat-resisting resin film of a polyimide family and has a surface resistivity of $10^5$–$10^9\Omega/cm^2$.

116. The image forming apparatus of claim 115, wherein thickness of the substrate member is between 50 $\mu$m and 200 $\mu$m.

117. The image forming apparatus claim 114, wherein the surface layer comprises a coat layer including at least one of perfluoroalkoxy and polytetrafluoroethylene, and has a surface resistivity of $10^8$–$10^{12}\Omega/cm^2$.

118. The image forming apparatus of claim 117, wherein thickness of the surface layer is 20 $\mu$m or smaller and surface roughness (Rz) of the surface layer is 10 or smaller.

119. The image forming apparatus of claim 114, wherein the endless belt second image bearing member comprises electron conduction material including at least one of carbon or metal oxide.

120. A transfer belt for use in an image forming apparatus in which a first visual image transferred from a first image bearing member onto a second image bearing member is transferred onto a first side of a recording medium from the second image bearing member and a second visual image is transferred from the first image bearing member onto a second side of the recording medium, so that the visual images are formed on the first and second sides of the recording medium, wherein the transfer belt has a heat-resisting property against heat of 150–300° C., the transfer belt is formed in two layers including a substrate member and a surface layer, and the transfer belt has a volume resistivity of $10^6$–$10^{12}\Omega\cdot$cm.

121. The transfer belt of claim 120, wherein the substrate member comprises a heat-resisting resin film of a polyimide family and has a surface as resistivity of $10^5$–$10^9\Omega/cm^2$.

122. The transfer belt of claim 121, wherein thickness of the substrate member is between 50 $\mu$m and 200 $\mu$m.

123. The transfer belt of claim 120, wherein the surface layer comprises a coat layer including at least one of perfluoroalkoxy and polytetrafluoroethylene, and has a surface resistivity of $10^8$–$10^{12}\Omega/cm^2$.

124. The transfer belt of claim 123, wherein thickness of the surface layer is 20 $\mu$m or smaller and surface roughness (Rz) of the surface layer is 10 or smaller.

125. The transfer belt of claim 120, further comprising electron conduction material including at least one of carbon or metal oxide.

126. An image forming apparatus, comprising:

first image bearing means for bearing a visual image;

second image bearing means for bearing the visual image; and fixing means for fixing the visual image transferred onto a recording medium, said fixing means opposing the second image bearing member, wherein a first visual image formed on the first image bearing means is transferred onto the second image bearing means for transferring from the second image bearing means onto a first side of the recording medium, wherein a second visual image formed on the first bearing means is transferred from the first image bearing means onto a second side of the recording medium, so that the first and second visual images are obtained on the first and second sides of the recording medium respectively, and wherein the first and second visual images on the first and second sides of the recording medium are fixed by the fixing means in a state that the recording medium is interposed between the second image bearing means and the fixing means.

127. An image forming apparatus, comprising:

first image bearing means for bearing a visual image;

second image bearing means for bearing the visual image transferred from the first image bearing means;

fixing means for fixing the visual image transferred onto a recording medium, said fixing means opposing the second image bearing member;

first transfer means for transferring a first visual image carried by the first image bearing means onto the second image bearing means or for transferring a second visual image carried on the first image bearing means to the recording medium; and second transfer means for transferring the first visual image carried by the second image bearing means onto the recording medium, wherein the first visual image is transferred from the second image bearing means onto a first side of the recording medium, the second visual image is transferred from the first image bearing means onto a second side of the recording medium, so that the first and second visual images are obtained on the first and second sides of the recording medium respectively, and wherein the visual images on the first and second sides of the recording medium are fixed by the fixing means in a state that the recording medium is interposed between the second image bearing means and the fixing means.

128. An image forming apparatus, comprising:

first image bearing means for bearing an image, having a photoconductive property;

developing means for visualizing the image on the first image bearing means into a toner image;

second image bearing means for bearing the toner image transferred from the first image bearing means; and fixing means for fixing the toner image transferred onto a recording medium, said fixing means opposing the second image bearing means, wherein a first toner image formed on the first image bearing means is transferred onto the second image bearing member for transferring from the second image bearing means onto a first side of the recording medium, wherein a second toner image formed on the first image bearing means is transferred onto a second side of the recording medium, so that the toner images are obtained on the first and second sides of the recording medium respectively, and wherein the toner images on the first and second sides of the recording medium are fixed by the fixing means in a state that the recording medium is interposed between the second image bearing means and the fixing means.

129. An image forming apparatus, comprising:

first image bearing means for bearing an image;

second image bearing means for bearing the image transferred from the first image bearing means;

charging means for charging the image born on the second image bearing means; and fixing means for fixing the image transferred onto a recording medium;

wherein a first image formed on the first image bearing means and transferred onto the second image bearing means and a second image formed on the first image bearing means are transferred onto both sides of the recording medium at substantially a same time, and the recording medium is conveyed to a fixing area of the fixing means by the second image bearing means, and wherein after the first image is transferred from the first image bearing means onto the second image bearing means, a charging polarity of the first image is reversed on the second image bearing means by the charging means so that the first and the second images are transferred onto the both sides of the recording medium at substantially the same time.

130. An image forming apparatus, comprising:

first image bearing means for bearing a first image;

second image bearing means for bearing the first image transferred from the first bearing means;

wherein the first visual image transferred from the first image bearing member onto the second image bearing member is transferred onto a first side of a recording medium and a second visual image is transferred from the first image bearing means onto a second side of the recording medium, so that the visual images are formed on the first and second sides of the recording medium, and wherein the second image bearing means comprises a heat-resisting transfer belt having a heat-resisting property against heat of 150–300° C. and a volume resistivity of $10^6$–$10^{12}\Omega\cdot$cm, and formed in at least two layers including a substrate member and a surface layer.

131. An image forming method, comprising steps of:

transferring a first image formed on a first image bearing member onto a second image bearing member transferring a second image formed on the first image bearing member onto a second side of a recording medium;

transferring the first image from the second image bearing member to a first side of the recording medium; and fixing the first and second images on the first and second sides of the recording medium in a state that the recording medium is interposed between the second image bearing member and the fixing means.

132. The image forming method of claim 131, further comprising a step of setting a condition as to whether to obtain one of or both of the images on the first and second sides of the recording medium.

133. The image forming method of claim 131, further comprising a step of cooling the second image bearing member.

134. The image forming method of claim 133, wherein the cooling of the second image bearing member is performed after the first image on the second intermediate transfer member is transferred onto the recording medium.

135. The image forming method of claim 131, further comprising a step of cleaning the second image bearing member.

136. The image forming method of claim 131, further comprising a step of reversing a charging polarity of the first image on the second image bearing member, and wherein the transferring of the second image formed on the first image bearing member onto the second side of a recording medium and the transferring of the first image from the second image bearing member to the first side of the recording medium are performed at substantially a same time.

137. The image forming method of claim 136, wherein the transferring of the second image formed on the first image bearing member onto the second side of the recording medium and the transferring of the first image from the second image bearing member to the first side of the recording medium at the same time includes applying a transfer electric field.

138. The image forming method of claim 131, wherein the second image bearing member is formed as an endless belt, and the method further comprising a step of opening a unit accommodating the endless belt second image bearing member relative to a main body accommodating the first image bearing member.

139. The image forming method of claim 131, wherein the second image bearing member is shaped in a form of an endless belt, and the method further comprising a step of changing a temperature of at least one of a first fixing device arranged inside of a loop of the endless belt second image bearing member and a second fixing devices arranged outside of the loop when obtaining one of the images on the first and second sides of the recording medium from when obtaining both of the images.

140. The image forming method of claim 131, wherein the second image bearing member is formed as an endless belt, and the method further comprising a step of individually controlling temperatures of a first fixing device arranged inside of a loop of the endless belt second image bearing member and a second fixing devices arranged outside of the loop.

141. The image forming method of claim 131, the second image bearing member is formed as an endless belt, and the method further comprising a step of stopping heating of, or decreasing the temperature of at least one of a first fixing device arranged inside of a loop of the endless belt second image bearing member and a second fixing device arranged outside of the loop.

142. The image forming method of claim 131, wherein the second image bearing member is formed as an endless belt, and the method further comprising a step of separating a fixing device arranged outside of a loop of the endless belt second image bearing member from the endless belt second image bearing member.

143. The image forming method of claim 131, wherein the second image bearing member is formed as an endless belt, and the method further comprising a step of detecting a temperature of the endless belt second image bearing member.

144. An image forming method, comprising steps of.

transferring a first image formed on a first image bearing member onto a second image bearing member reversing a polarity of the first image on the second image bearing member;

transferring the first image on the second image bearing member onto a first side of a recording medium and a second image formed on the first image bearing member onto a second side of the recording medium at a same time; and conveying the recording medium to a fixing area of a fixing device by the second image bearing member.

145. The image forming method of claim 144, further comprising a step of fixing the images on the first and second sides of the recording medium onto the recording medium while the recording medium is being conveyed by the second image bearing member.

* * * * *